US009908217B2

(12) United States Patent
Sarangi et al.

(10) Patent No.: US 9,908,217 B2
(45) Date of Patent: Mar. 6, 2018

(54) ABRASIVE ARTICLE INCLUDING AGGLOMERATES HAVING SILICON CARBIDE AND AN INORGANIC BOND MATERIAL

(71) Applicants: SAINT-GOBAIN ABRASIVES, INC., Worcester, MA (US); SAINT-GOBAIN ABRASIFS, Conflans-Sainte-Honorine (FR)

(72) Inventors: Nilanjan Sarangi, Shrewsbury, MA (US); Sandhya Jayaraman Rukmani, Westborough, MA (US); Stephen E. Fox, Worcester, MA (US); Russell L. Krause, Shrewbury, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 70 days.

(21) Appl. No.: 14/956,246

(22) Filed: Dec. 1, 2015

(65) Prior Publication Data

US 2016/0151885 A1 Jun. 2, 2016

Related U.S. Application Data

(60) Provisional application No. 62/086,112, filed on Dec. 1, 2014.

(51) Int. Cl.
*B24D 3/18* (2006.01)
*B24D 3/04* (2006.01)

(52) U.S. Cl.
CPC ..... *B24D 3/18* (2013.01)

(58) Field of Classification Search
CPC ..... B24D 3/18; B24D 3/04
See application file for complete search history.

(56) References Cited

U.S. PATENT DOCUMENTS

| | | | |
|---|---|---|---|
| 2,216,728 | A | 10/1940 | Benner et al. |
| 2,332,241 | A | 10/1943 | Lombard et al. |
| 3,183,071 | A | 5/1965 | Rue et al. |
| 4,364,746 | A | 12/1982 | Bitzer et al. |
| 4,575,384 | A | 3/1986 | Licht et al. |
| 5,095,665 | A | 3/1992 | Nagata et al. |
| 5,118,326 | A | 6/1992 | Lee et al. |
| 5,711,774 | A | 1/1998 | Sheldon |
| 5,725,162 | A | 3/1998 | Garg et al. |
| 5,738,696 | A | 4/1998 | Wu |

(Continued)

FOREIGN PATENT DOCUMENTS

| | | | |
|---|---|---|---|
| WO | 03070428 | A1 | 8/2003 |
| WO | 2016089924 | A1 | 6/2016 |

OTHER PUBLICATIONS

International Search Report for PCT/US2015/063265, dated Mar. 7, 2016, 1 page.

(Continued)

*Primary Examiner* — Pegah Parvini
(74) *Attorney, Agent, or Firm* — Thomas Osborn; Abel Law Group, LLP

(57) ABSTRACT

An abrasive article including a body including a bond material having an inorganic material including a ceramic, abrasive agglomerates including silicon carbide contained within the bond material, and a permeability of at least 60.

20 Claims, 6 Drawing Sheets

(56) References Cited

U.S. PATENT DOCUMENTS

| | | | | |
|---|---|---|---|---|
| 5,779,743 | A | 7/1998 | Wood | |
| 2007/0155293 | A1* | 7/2007 | Endres | C03C 10/00 451/56 |
| 2008/0222967 | A1 | 9/2008 | Querel et al. | |
| 2008/0293345 | A1 | 11/2008 | Bright et al. | |
| 2009/0272482 | A1 | 11/2009 | Addiego et al. | |
| 2010/0139173 | A1* | 6/2010 | Soma | B24D 3/18 51/296 |
| 2010/0196700 | A1 | 8/2010 | Orlhac et al. | |
| 2012/0034847 | A1 | 2/2012 | Besse et al. | |
| 2013/0000212 | A1 | 1/2013 | Wang et al. | |
| 2016/0151886 | A1 | 6/2016 | Sarangi et al. | |

OTHER PUBLICATIONS

International Search Report for PCT/US2015/063282, dated Mar. 11, 2016, 1 pg.

* cited by examiner

ABRASIVE ARTICLE INCLUDING AGGLOMERATES HAVING SILICON CARBIDE AND AN INORGANIC BOND MATERIAL

CROSS-REFERENCE TO RELATED APPLICATION(S)

This application claims priority under 35 U.S.C. § 119(e) to U.S. Patent Application No. 62/086,112 entitled "ABRASIVE ARTICLE INCLUDING AGGLOMERATES HAVING SILICON CARBIDE AND AN INORGANIC BOND MATERIAL," by Nilanjan SARANGI et al., filed Dec. 1, 2014, which is assigned to the current assignee hereof and incorporated herein by reference in its entirety.

BACKGROUND

Field of the Disclosure

The following is directed to abrasive articles, and particularly, abrasive articles including agglomerates including silicon carbide and an inorganic bond material.

Description of the Related Art

Grinding of titanium has proven to be difficult and various types of bonded abrasive articles have been contemplated. U.S. Pat. No. 2,216,728 discloses the formation of aggregates of a plurality of smaller grains of diamond or boron carbide held in the aggregate by a bond which may be a metal, clay, glass or an organic polymer. The method of formation of the aggregates will vary slightly depending on the nature of the bonding medium employed. If metal is the bond then the metal powder and fine abrasive particles, e.g. diamond, are mixed together and hot pressed at a temperature of from 700° to 1500° depending on the metal used. Ceramic bonded aggregates are made by mixing about 5% clay with 95% fine abrasive grain with the usual liquid to give the mixture the needed consistency. The mix is then fired at for example 1250° C. to vitrify the clay bond.

U.S. Pat. No. 3,183,071 discloses bonded particles of very fine crystalline alumina having a particle size of less than 5 microns. Abrasive pellets of various cross sections are formed by extruding mixtures of fine alumina particles and a bond, cutting the extrudate at the desired size, and firing the green pellets. The bond is a silicate glass which has a final fired weight composition of 10-25% alumina, 50-70% silica, 5-15% calcia, 10-20% magnesia, and up to about 3% impurities. The fired pellets are bonded into a grinding wheel and used to snag grind stainless steel.

U.S. Pat. No. 4,364,746 discloses prebonded abrasive aggregates made up of fine particles of an abrasive material such as alumina or silicon carbide bonded into the larger abrasive particles by a resin or polymer. Aggregate particles of different strengths are made by incorporating various types and amounts of filler materials in the resin or polymer binder used to hold the fine abrasive particles together to form the larger abrasive agglomerates.

U.S. Pat. No. 5,711,774 discloses a vitreous bonded abrasive grinding wheel for grinding of titanium-containing materials. The wheel includes silicon carbide abrasive grain, hollow ceramic spheres, and a low temperature, high strength bond. The wheel apparently has improved performance characteristics due to a lowered content of lithium oxide in the bond and use of ceramic pore formers.

U.S. Pat. No. 4,575,384 discloses an abrasive product for grinding titanium metal and its alloy. The product used to grind the titanium consists of a grinding wheel wherein the abrasive grains are aggregates of silicon carbide particles bonded together with a refractory bond such as silicon oxynitride or a silicate based material.

U.S. Pat. No. 5,118,326 discloses a vitreous bonded abrasive grinding wheel for grinding of titanium-containing materials. The wheel includes a blend of silicon carbide and alumina abrasive grain.

The disclosed abrasive aggregates are also utilized with the more conventional type abrasive grains such as fused crushed alumina, alumina-zirconia and the like, including silicon carbide, boron carbide and the diamond.

SUMMARY

For one aspect, an abrasive article comprises a body including a bond material comprising an inorganic material comprising a ceramic, abrasive agglomerates comprising silicon carbide contained within the bond material, and a permeability of at least 60.

According to one aspect, an abrasive article comprises a body including a bond material comprising an inorganic material comprising a ceramic, abrasive agglomerates comprising silicon carbide contained within the bond material, a ceramic pore former contained within the bond material, the ceramic pore former present in an amount of not greater than 5 vol % for a total volume of the body, and a porosity of at least 40 vol % for the total volume of the body.

In yet another aspect, an abrasive article comprises a body including a bond material comprising an inorganic material comprising a ceramic, abrasive agglomerates contained within the bond material comprising silicon carbide particles, a porosity of at least 40 vol % for a total volume of the body, and a primary pore size maxima of at least 180 microns.

According to one aspect, a method of forming an abrasive article comprises forming a mixture including abrasive particles comprising silicon carbide and a binder comprising an inorganic material, forming abrasive agglomerates of the abrasive particles and binder by partially curing at least a portion of the binder, mixing the abrasive agglomerates with a bond material, and heat treating the abrasive agglomerates and bond material to form a bonded abrasive comprising abrasive agglomerates contained in a vitreous bond material, wherein the vitreous bond material is formed of a mixture of the binder and bond material.

In another aspect, an abrasive article includes a body having a bond material comprising an inorganic material comprising a ceramic, abrasive agglomerates comprising silicon carbide contained within the bond material, and an average pore size of at least 70 microns.

For another aspect, an abrasive article comprises a body including a bond material comprising an inorganic material comprising a ceramic, abrasive agglomerates comprising silicon carbide contained within the bond material, and a median pore size of at least 45 microns.

According to one aspect, an abrasive article comprises a body including a bond material comprising an inorganic material comprising a ceramic, abrasive agglomerates comprising silicon carbide contained within the bond material, and an upper quartile pore size limit of at least 85 microns.

In one aspect, an abrasive article comprises a body including a bond material comprising an inorganic material comprising a ceramic, abrasive particles comprising silicon carbide contained within the bond material, and an average pore size of at least 70 microns and a pore size standard deviation of at least 77 microns.

For another aspect, an abrasive article comprises a body including a bond material comprising an inorganic material comprising a ceramic, abrasive particles comprising silicon carbide contained within the bond material, and an average pore size of at least 70 microns and a pore size variance of at least 10 microns$^2$.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is directed to abrasive articles including bonded abrasive articles suitable for grinding of titanium-containing metals, including but not limited to titanium-based metals and titanium-based metal alloys, such as titanium aluminum alloys (i.e., TiAl metal). Of the many metals and alloys of commercial importance, titanium metal and its alloys can be the most difficult to process via grinding. Titanium-containing metals, including titanium-based metals and titanium-based metal alloys can be an extremely difficult to grind because of their highly susceptible to oxidation, especially at elevated temperatures such as those created during grinding. The oxidation reaction is highly exothermic thereby generating a substantial amount of heat which is additive with the normal heat of grinding experienced grinding any metal. To compound the problem, titanium-based metals generally have relatively low thermal conductivity as compared with the ferrous metals, which results in a greater concentration of heat at the grinding surface. Abrasive articles including silicon carbide abrasive particles have been found to be advantageous relative to certain oxide-based abrasive particles because the silicon carbide particles are resistant to dissolution in the hot titanium during grinding.

Figure 1:
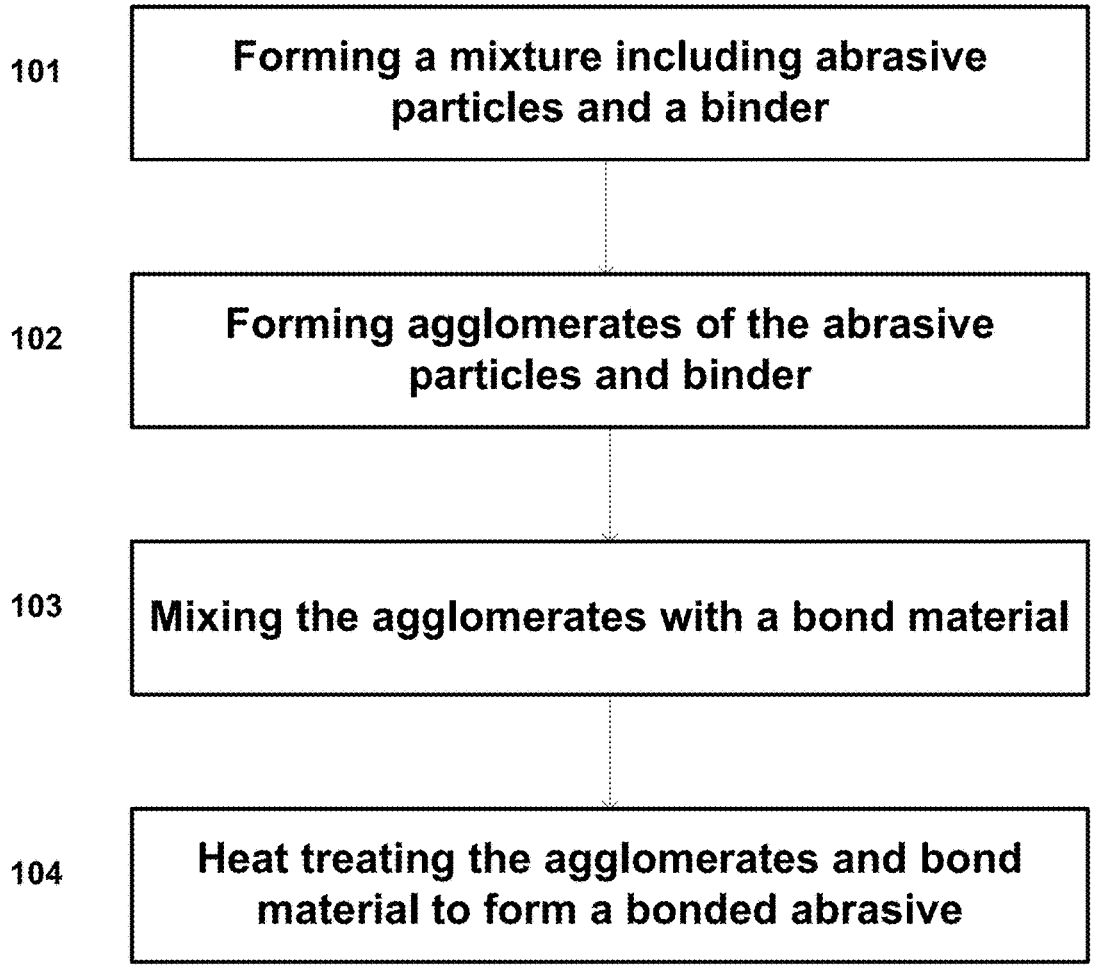
FIG. 1 includes a flow chart providing a process of forming an abrasive article according to an embodiment.

FIG. 1 includes a flowchart illustrating a process of forming an abrasive article in accordance with an embodiment. As illustrated, at step 101, the process can be initiated by forming a mixture including abrasive particles in a binder. In accordance with an embodiment, the abrasive particles can include silicon carbide. More particularly, the abrasive particles can be silicon carbide-based material such that a majority content of the abrasive particles includes silicon carbide. In still another embodiment, the abrasive particles can consist essentially of silicon carbide.

Furthermore, the binder may include a powder material that may include a frit. Notably, the binder includes can include an inorganic material, such as a ceramic. As used herein, a reference to a ceramic can include a composition including at least one metal element and at least one non-metal element. For example, a ceramic may include material such as oxides, carbides, nitrides, borides, and a combination thereof. More particularly, a ceramic material may have a vitreous phase, crystalline phase, polycrystalline phase, and a combination thereof.

In accordance with an embodiment, the abrasive particles can have an average particle size of at least 0.1 microns, such as at least 1 micron, at least 5 microns, at least 10 microns, at least 20 microns, at least 30 microns, or even at least 40 microns. Still, in another non-limiting embodiment, the abrasive particles can have an average particle size of not greater than 5000 microns, such as not greater than 4000 microns, or even not greater than 3000 microns, not greater than 2000 microns, not greater than 1000 microns, not greater than 500 microns, not greater than 100 microns, or even not greater than about 90 microns. It will be appreciated that the abrasive particles can have an average particle size within a range including any of the minimum and maximum values noted above.

In one embodiment, the binder can include an oxide-based material, including for example certain contents of silica, boron oxide, and a combination thereof. In at least one embodiment, the binder can include a borosilicate composition. More particularly, the binder can have a composition including silicon dioxide ($SiO_2$), boron oxide ($B_2O_3$), clay, and a water glass-based composition combination thereof.

According to a particular embodiment, the mixture including the binder and the abrasive particles may also include one or more filler materials. The filler material can be distinct from the abrasive particles and may have a hardness less than a hardness of the abrasive particles. The filler material may provide improved mechanical properties and facilitate formation of the abrasive agglomerates according to the embodiments. In at least one embodiment, the filler material can include various materials, such as fibers, woven materials, non-woven materials, particles, minerals, nuts, shells, oxides, alumina, carbide, nitrides, borides, organic materials, polymeric materials, naturally occurring materials, and a combination thereof. In particular instances, the filler material can include a material such as wollastonite, mullite, steel, iron, copper, brass, bronze, tin, aluminum, kyanite, alusite, garnet, quartz, fluoride, mica, nepheline syenite, sulfates (e.g., barium sulfate), carbonates (e.g., calcium carbonate), cryolite, glass, glass fibers, titanates (e.g., potassium titanate fibers), rock wool, clay, sepiolite, an iron sulfide (e.g., $Fe_2S_3$, $FeS_2$, or a combination thereof), fluorspar ($CaF_2$), potassium sulfate ($K_2SO_4$), graphite, potassium fluoroborate ($KBF_4$), potassium aluminum fluoride ($KAlF_4$), zinc sulfide (ZnS), zinc borate, borax, boric acid, fine alundum powders, P15A, bubbled alumina, cork, glass spheres, silver, Saran™ resin, paradichlorobenzene, oxalic acid, alkali halides, organic halides, and attapulgite.

Formation of the mixture can include forming a dry or wet mixture. It may be suitable to create a wet mixture to facilitate suitable dispersion of the abrasive particles within the binder. Moreover, it will be appreciated that the mixture can include other materials, including for example a filler, additives, binders, and any other materials known in the art to facilitate formation of a mixture to create a green product prior to formation of a vitrified bonded abrasive. In at least one embodiment, the mixture is essentially free of a pore former.

Referring to FIG. 1, after forming a mixture including abrasive particles and binder at step 101, the process can continue at step 102 by forming agglomerates of the abrasive particles and binder. As used herein reference to an agglomerate is reference to a particle including smaller particles (e.g., abrasive particles) contained within a binder material that may be a substantially uniform and continuous three-dimensional phase of material extending throughout the volume of the agglomerate. The binder material may include a certain content of a vitreous phase. An agglomerate may be distinct from an aggregate, which is a composite of various sizes of discrete particles bonded to each other in the form of a particulate mass. Notably, an aggregate does not include a continuous binder extending throughout the volume of the particulate mass.

The process of forming the abrasive agglomerates can include partially curing at least a portion of the binder. The process of forming the abrasive agglomerates can include partially curing the binder, which may include converting at least a portion of the binder to a liquid phase during heat treatment such that it is sufficient to bond the plurality of abrasive particles together to form the abrasive agglomerates. More particularly, the process of forming abrasive agglomerates can include heating the mixture to a forming temperature of at least 100° C., such as at least 125° C., at least 150° C., at least 175° C., at least 200° C., at least 250° C., or even at least 300° C. Still, in another non-limiting embodiment, the forming temperature can be not greater than 500° C., not greater than 450° C., not greater than 400° C., not greater than 350° C., or even not greater than 300° C. It will be appreciated that the forming temperature can be within a range including any of the minimum and maximum temperatures noted above. Reference herein to the forming temperature can be the melting temperature of the material, and may be suitable for having the binder material form a liquid phase, which can facilitate the formation of the abrasive agglomerates.

The heating process can be conducted for a particular duration to facilitate formation of the abrasive agglomerates. For example, forming of the abrasive agglomerates can include holding at the forming temperature for a particular duration, such as at least 1 minute, at least 3 minutes, at least 5 minutes or even at least 10 minutes. In another non-limiting embodiment, the heating process can include holding the mixture at the forming temperature for not greater than 30 minutes, such as not greater than 20 minutes, or even not greater than 15 minutes to facilitate formation of the abrasive agglomerates. It will be appreciated that the duration at the forming temperature can be within a range including any of the minimum and maximum values noted above.

In accordance with an embodiment, formation of the abrasive agglomerates can include heating the mixture in an oxidizing atmosphere or anon-oxidizing atmosphere. Some suitable non-oxidizing atmospheres can include one or more noble gas species and/or nitrogen. In at least one embodiment, the process forming the abrasive agglomerates can include heating the mixture in a nitrogen-rich atmosphere, which may include at least 51 vol % nitrogen, and more particularly in an atmosphere consisting essentially of nitrogen. In still another embodiment, the formation of the abrasive agglomerates can include heating in an atmosphere of ambient air.

In accordance with an embodiment, the abrasive agglomerates can have an average particle size (D50) of at least about at least 50 microns, at least 60 microns, at least 70 microns, at least 80 microns, at least 90 microns, at least 100 microns, at least 110 microns, at least 120 microns, at least 130 microns, at least 140 microns, or even at least 150 microns. Still, in another non-limiting embodiment, the abrasive agglomerates can have an average particle size of not greater than 5000 microns, such as not greater than 4000 microns, not greater than 3000 microns or even not greater than 2000 microns. It will be appreciated that the abrasive agglomerates can have an average particle size within a range including any of the minimum and maximum values noted above.

Referring again to FIG. 1, after forming the abrasive agglomerates of the abrasive particles and binders at step 102, the process can continue at step 103, which can include mixing the abrasive agglomerates with a bond material. Notably, the bond material can have a composition that is distinct from the binder. The bond material may also be referred to as a precursor bond material, which can be in the form of a powder material until it is heat treated and forms the finally-formed bond material of the abrasive article. More particularly, the bond material can include an oxide-based composition, which may include some content of silica, boron oxide, alumina, zircon, sodium oxide, potassium oxide, iron oxide, titanium oxide, magnesium oxide, calcium oxide, and the like. The composition of the precursor bond material is used to form the bond material of the finally-formed bonded abrasive body. Contents of the bond material of the finally-formed bonded abrasive body are disclosed in more details hereinafter. The composition of the bond precursor material and the bond material of the finally-formed bonded abrasive body can be substantially the same (i.e., 5% or less difference in any one of the components between the precursor bond material and bond material of the finally-formed bonded abrasive body) or essentially the same (i.e., 1% or less difference in any one of the components between the precursor bond material and bond material of the finally-formed bonded abrasive body).

In accordance with an embodiment, the bond material can include zircon. In at least one particular embodiment, the bond material includes a content of zircon that is greater than a content of zircon within the binder. Moreover, in at least one embodiment, the binder can be essentially free of zircon and the bond material can include at least 5 wt % zircon for the total weight of the bond material.

The bond material can have a particular melting temperature that may facilitate suitable formation and performance of the abrasive article. In at least one instance, the bond material (i.e., the precursor bond material and not the finally-formed bond material) can have a melting temperature that is greater than the melting temperature of the binder. More particularly, the bond material may have a melting temperature that is at least about 2%, greater than the melting after the binder as calculated by the formula $[(Tbm-Tb)/Tbm]\times100\%$, wherein Tbm represents the melting temperature of the bond material and Tb is the melting temperature of the binder. In another non-limiting embodiment, the bond material can have a melting temperature that is at least about 5% greater, such as at least about 10% greater, at least about 20%, at least 30%, at least 40% at least 50% or even at least 60% greater than the melting temperature of the binder. In a non-limiting embodiment, the melting temperature of the bond material may be not greater than 90%, such as not greater than 80%, or even not greater than 70% greater than the melting temperature of the binder, which may facilitate suitable formation. It will be appreciated that the difference in the melting temperature between the bond material and the binder can be within a range including any of the minimum and maximum percentages noted above.

In certain instances, unagglomerated abrasive particles may be added to the mixture of the abrasive agglomerates and the bond material. The unagglomerated abrasive particles can include materials such as oxides, carbides, nitrides, borides, carbon-based materials (e.g., diamond), oxycarbides, oxynitrides, oxyborides, and a combination thereof. In certain instances, the unagglomerated abrasive particles can be particularly hard, having for example, a Mohs hardness of at least 6, such as at least 6.5, at least 7, at least 8, at least 8.5, at least 9. According to one embodiment, the unagglomerated abrasive particles can include a superabrasive material. The unagglomerated abrasive particles can include a material selected from the group of silicon dioxide, silicon carbide, alumina, zirconia, flint, garnet, emery, rare earth oxides, rare earth-containing materials, cerium oxide, sol-gel derived particles, gypsum, iron oxide, glass-containing particles, and a combination thereof. In another instance, unagglomerated abrasive particles may also include silicon carbide (e.g., Green 39C and Black 37C), brown fused alumina (57A), seeded gel abrasive, sintered alumina with additives, shaped and sintered aluminum oxide, pink alumina, ruby alumina (e.g., 25A and 86A), electrofused monocrystalline alumina 32A, MA88, alumina zirconia abrasives (NZ, NV,ZF), extruded bauxite, cubic boron nitride, diamond, abral (aluminum oxy-nitride), sintered alumina (Treibacher's CCCSK), extruded alumina (e.g., SR1, TG, and TGII), or any combination thereof. According to one particular embodiment, the unagglomerated abrasive particles consist essentially of silicon carbide. The unagglomerated abrasive particles may be diluent grains, having a hardness less than the abrasive agglomerates, but still harder than filler materials that may be present in the abrasive article. In still other instances, the abrasive particles may include shaped abrasive particles, which unlike crushed grains, each shaped abrasive particles can have a precise and substantially similar shape relative to each other For at least one embodiment, the unagglomerated abrasive particles can have a particular average particle size that facilitates formation of the abrasive article and may improve performance of the abrasive article. For example, the unagglomerated abrasive particles can have an average particle size (D50) of at least 1 micron, such as at least 5 microns, at least 10 microns, at least 20 microns, at least 30 microns, at least 40 microns or even at least 50 microns. In one non-limiting embodiment, the unagglomerated abrasive particles may have an average particle size (D50) of not greater than 2600 microns, such as not greater than 2550 microns, not greater than 2500 microns, not greater than 2300 microns, not greater than 2000 microns, not greater than 1800 microns, not greater than 1500 microns, not greater than 1200 microns, not greater than 1000 microns, not greater than 800 microns, not greater than 600 microns, not greater than 300 microns, not greater than 200 microns, not greater than 150 microns or even not greater than 100 microns. It will be appreciated that the unagglomerated abrasive particles can have an average particle size within a range including any of the minimum and maximum values noted above.

In certain instances, the unagglomerated abrasive particles can have an average particle size (D50uap) that has a particular relationship relative to the average particle size (D50aa) of the abrasive agglomerates. For example, the unagglomerated abrasive particles can have an average particle size (D50uap) that is less than the average particle size (D50aa) of the abrasive agglomerates. More particularly, the body can have a ratio (D50upa/D50aa) that is not greater than 1, such as greater than 0.95, not greater than 0.9, not greater than 0.8, not greater than 0.7, not greater than 0.6, not greater than 0.5, not greater than 0.4, or even not greater than 0.3. Still, in at least one embodiment, the ratio (D50upa/D50aa) can be at least 0.01, at least 0.05, at least 0.1, at least 0.15, at least 0.2, at least 0.25, at least 0.3, at least 0.35, at least 0.4, at least 0.5. It will be appreciated that the ratio (D50upa/D50aa) can be within a range including any of the minimum and maximum values noted above.

The mixture, and thus the finally-formed abrasive article, can include a particular content of unagglomerated abrasive particles relative to the total content of abrasive particles in the abrasive article. For example, the unagglomerated abrasive particles can be present in an amount of at least 1% for the total content of abrasive particles (i.e., abrasive particles in the abrasive agglomerates and unagglomerated abrasive particles), such as at least 2%, at least 5%, at least 8%, at least 10%, at least 15%, at least 20%, at least 25%, at least 30%, at least 35%, at least 40%, at least 45% or even at least 50% of the total content of abrasive particles. Still, in another embodiment, the unagglomerated abrasive particles can be present in an amount of not greater than 60%, such as not greater than 55%, not greater than 50%, not greater than 45%, not greater than 40%, not greater than 35%, not greater than 30%, not greater than 25%, not greater than 20%, not greater than 15%, not greater than 12%, not greater than 10%, not greater than 8%, not greater than 6%, not greater than 4%, not greater than 2%, not greater than 1%. It will be appreciated that the content of unagglomerated abrasive particles relative to the total content of abrasive particles in the body can be within a range including any of the minimum and maximum percentages noted above.

In more particular terms, the bond material may have a forming temperature, which may be the material's melting temperature, of at least 800° C., such as at least 825° C., or even at least 850° C. Still, in another non-limiting embodiment, the bond material can have a melting temperature of not greater than 1000° C., not greater than 990° C., not greater than 980° C., not greater than 970° C., not greater than 960° C., or even not greater than 950° C. It will be appreciated that the bond material can have a melting temperature within a range including any of the minimum and maximum values noted above.

Referring again to FIG. 1, after mixing the abrasive agglomerates with the bond material of 103, the process of forming the abrasive article can continue at step 104, which includes heat treating the abrasive agglomerates and bond material to form a bonded abrasive. In accordance with an embodiment, the process of heat treating can include heating the abrasive agglomerates and bond material to a temperature sufficient to cause mixing of the binder and bond material to form a vitreous bond material. That is, the finally-form bonded abrasive body can include a vitreous bond material that has a composition that is a blend of the binder and bond material, wherein the heat treating operation is conducted in a manner suitable to ensure at least partial mixing of the binder and bond material. In accordance with an embodiment, heat treating can include heating the abrasive agglomerates and bond material to a forming temperature of not greater than 950° C., such as not greater than 940° C., or even not greater than 930° C. Still, in at least one non-limiting embodiment, the process of heat treating can include heating the abrasive agglomerates and bond material to a forming temperature of at least 850° C., such as at least 875° C., or even at least 900° C. It will be appreciated that the process of heat treating can include heating the abrasive agglomerates and bond material to a forming temperature within range including any of the minimum and maximum values noted above. The forming temperature can be the melting temperature, as the melting of the precursor bond material and the binder facilitates the mixing and combination of the binder and precursor bond material to form the vitreous bond material of the finally-formed bonded abrasive.

Heat treating may further include heating agglomerates and bond material in a non-oxidizing atmosphere. In at least another embodiment, the process of heat treating can include heating the abrasive agglomerates and bond material in a nitrogen-rich atmosphere, and more particularly an atmosphere that consists essentially of nitrogen. Furthermore will be appreciated that a non-oxidizing atmosphere can include one or more noble gases. Still, in another embodiment, the process of heat treating can be conducted in an ambient atmosphere (i.e., air).

After heat treating to form the bonded abrasive body, the bonded abrasive body may be incorporated into an abrasive article. It will be appreciated that the bonded abrasive body may have any suitable size and shape as known in the art and can be incorporated into various types of abrasive articles to form a bonded abrasive article suitable for conducting material removal operations, particularly material removal operations on titanium-containing metal and titanium-containing metal alloys, and more particularly, titanium-based metals and metal alloys, such as titanium aluminide, Ti-6Al-4V and the like. For example, the bonded abrasive body can be attached to a substrate, such as a hub of a wheel to facilitate formation of a bonded abrasive grinding wheel.

The bonded abrasive article disclosed herein may also be used for material removal operations performed on certain other materials, such as a nickel-containing material, which can be for example, nickel-containing metals and nickel-containing metal alloys and particularly include nickel-based metals and metal alloys. In a non-limiting embodiment, the nickel-containing material can include INCONEL® alloy 617, INCONEL® alloy 625, INCONEL® alloy 625LCF®, INCONEL® alloy 706, INCONEL® alloy 718, INCONEL® alloy 718SPF™, INCONEL® alloy 725, INCONEL® alloy X-750, INCONEL® alloy MA754, INCONEL® alloy 783, INCONEL® alloy HX, NILO® alloy 42, NIMONIC® alloy 75, NIMONIC® alloy 80A, NIMONIC® alloy 86, NIMONIC® alloy 90, NIMONIC® alloy 105, NIMONIC® alloy 115, NIMONIC® alloy 901, NIMONIC® alloy PE16, NIMONIC® alloy PK33, NIMONIC® alloy 263, NILO® alloy 36, INCOLOY® alloy 903, INCOLOY® alloy 907, INCOLOY® alloy 909, INCOLOY® alloy A-286, UDIMET® alloy 188, UDIMET® alloy 520, UDIMET® alloy L-605, UDIMET® alloy 720, UDIMET® alloy D-979, UDIMET® alloy R41, Waspaloy, cast iron (e.g, grey cast iron, nodular cast iron, and chilled cast iron).

Certain types of materials other than the titanium-containing material or the nickel-containing material may also be suitable for material removal operations utilizing the bonded abrasive article disclosed herein. In a non-limiting embodiment, such material can include an aluminum-containing material (e.g., aluminum alloys), carbides (e.g., tungsten carbide), stainless steel, non-ferrous metals and alloys (e.g., copper, bronze, tin, brass, zinc, and the like), nitrided metals, rubber, plastics, composites, ceramics, and hardened steel.

Figure 2:
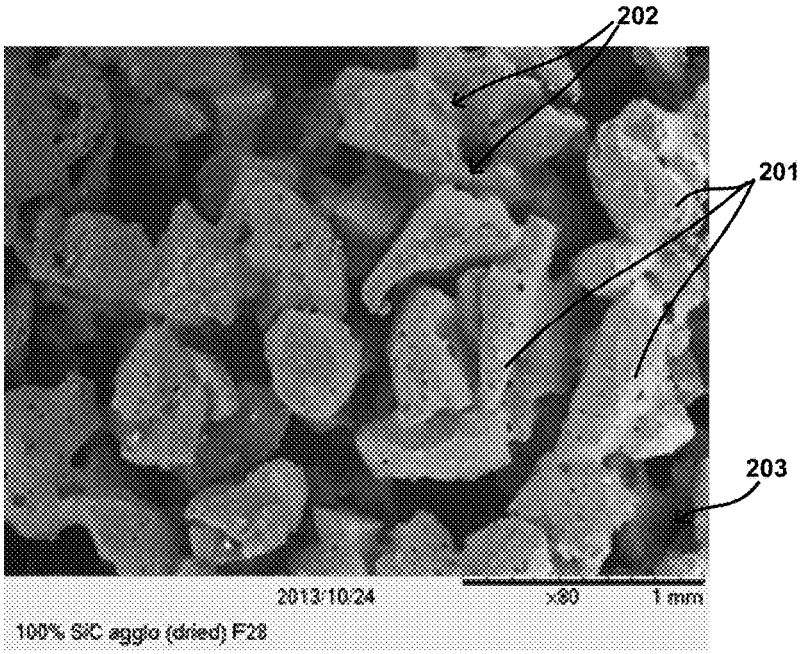
FIG. 2 includes an image of a portion of an abrasive article according to an embodiment.

FIG. 2 includes an image of a portion of a bonded abrasive body according to an embodiment. As noted, the bonded abrasive body includes abrasive agglomerates 201, which can include abrasive agglomerates 201, the bond material 202 in the form of bond bridges joining the abrasive agglomerates 201 and pores 203 extending between the bond material 202 and abrasive agglomerates 201. It should be noted that reference to the bond material 202 is the vitreous bond material formed from a mixture of the binder and bond material as described in the process of the embodiments herein.

The bonded abrasive body may include a particular content of bond material that may facilitate improved performance of the abrasive article. In accordance with an embodiment, the bonded abrasive can have a body including at least 3 vol % bond material for a total volume of the body. In still other embodiments, the bonded abrasive body can include at least 4 vol % or even at least 5 vol % bond material for a total volume of the body. In yet another non-limiting embodiment, the body of the bonded abrasive can have not greater than 20 vol % bond material, such as not greater than 18 vol %, not greater than 15 vol %, or even not great 12 vol % bond material for a total volume of the body. It will be appreciated that the bonded abrasive body can have a bond material content within a range including any of the minimum and maximum percentages noted above.

In accordance with another embodiment, the bonded abrasive body may have a particular content of porosity and type of porosity that facilitates improved performance of the abrasive article. In accordance with an embodiment the body can include at least 40 vol % porosity for a total volume of the body. In a more particular embodiment, the body can include at least 42 vol % porosity, such as at least 43 vol %, at least 44 vol % at least 45 vol %, at least 46 vol %, at least 47 vol %, at least 48 vol %, at least 49 vol %, at least 50 vol %, at least 51 vol %, at least 52 vol %, at least 53 vol % at least 54 vol %, at least 55 vol %, at least 56 vol %, at least 57 vol %, at least 58 vol %, at least 59 vol % at least 60 vol %, at least 61 vol %, or even at least 62 vol % porosity for a total volume of the body. Still, in other non-limiting embodiment, the body may include not greater than 75 vol %, such as not greater than 70 vol %, not greater than 78 vol %, not greater than 76 vol %, not greater than 74 vol %, not greater than 72 vol %, not greater than 70 vol %, not greater than 68 vol %, not greater than 66 vol % or even not greater than 64 vol % porosity for a total volume of the body. It will be appreciated that the body can include a content of porosity within a range including any of the minimum and maximum percentages noted above.

In accordance with an embodiment, the bonded abrasive body can have particularly large pores, which can facilitate improved performance. For example, the body can have an average pore size of at least about 70 microns, at least 80 microns, at least 85 microns, at least 90 microns, at least 95 microns, at least 100 microns, at least 110 microns, at least 120 microns, at least 130 microns, at least 140 microns, at least 150 microns, or even at least 160 microns. Still, in another non-limiting embodiment, the body can have an average pore size of not greater than 2000 microns, such as not greater than 1500 microns, not greater than 1000 microns, not greater than 900 microns, not greater than 800 microns or even not greater than 700 microns. It will be appreciated that the body can have an average pore size within a range including any of the minimum and maximum values noted above. Moreover, the average pore size can be measured using ASTM standard E112 Standard Test Methods for Determining Average Grain Size. Cross-sectional images of the body were viewed at 60× magnification on a Hitachi Microscope. The macro to determine pore length follows a technique to measure crystal size based on including drawing 6 equally spaced lines on the image and determining the regions of the line that intersect with a pore. The regions of the lines that intersect the pore are measured. This process was repeated for seven different images of portions of the bonded abrasive body. After all images were analyzed the values were averaged to calculate the average pore size. Moreover, it will be appreciated that reference to the average pore size can also be reference to a mean pore size.

In accordance with an embodiment, the bonded abrasive body can have particular median pore size that can facilitate improved performance. For example, the body can have a median pore size of at least about 45 microns, such as at least at least 50 microns, at least 55 microns, at least 60 microns, at least 65 microns, at least 70 microns, at least 75 microns, at least 80 microns or even at least 85 microns. Still, in another non-limiting embodiment, the body can have a median pore size of not greater than 2000 microns, such as not greater than 1500 microns, not greater than 1000 microns, not greater than 900 microns, not greater than 800 microns or even not greater than 700 microns, not greater than 500 microns or even not greater than 200 microns. It will be appreciated that the body can have a median pore size within a range including any of the minimum and maximum values noted above. Moreover, the median pore size can be measured using ASTM standard E112 Standard Test Methods for Determining Average Grain Size.

For certain other embodiments, the bonded abrasive body can have an upper quartile pore size limit, which defines the the smallest pore size defining the largest 25% of pores in the body (i.e., pore sizes of 75% to 100% of all pore sizes in the body). Stated alternatively, the upper quartile pore size limit is the pore size of pores at the $75^{th}$ percentile for the pore size distribution of the body obtained by a suitable statistical sampling of the body measured using ASTM standard E112. For example, the body can have a an upper quartile pore size limit pore size of at least about 85 microns, such as at least at least 90 microns, at least 100 microns, at least 110 microns, at least 120 microns, at least 130 microns, at least 140 microns, at least 150 microns, at least 160 microns, at least 170 microns, at least 180 microns, at least 190 microns or even at least 200 microns. Still, in another non-limiting embodiment, the body can have an upper quartile pore size limit of not greater than 2000 microns, such as not greater than 1500 microns, not greater than 1000 microns, not greater than 900 microns, not greater than 800 microns, not greater than 700 microns or even not greater than 500 microns. It will be appreciated that the body can have an upper quartile pore size limit within a range including any of the minimum and maximum values noted above.

In one embodiment, the bonded abrasive body can also have a particular pore size standard deviation that can facilitate improved performance of the abrasive article. The pore size standard deviation can be determined from measuring the pore size distribution of the body obtained by a suitable statistical sampling of the body measured using ASTM standard E112 and calculating the standard deviation from the pore size data. For example, the body can have a pore size standard deviation of at least about 85 microns, such as at least at least 90 microns, at least 100 microns, at least 110 microns, at least 120 microns, at least 130 microns, at least 140 microns, at least 150 microns, at least 160 microns, at least 170 microns, at least 180 microns, at least 190 microns or even at least 200 microns. Still, in another non-limiting embodiment, the porosity of the body can have a pore size standard deviation of not greater than 2000 microns, such as not greater than 1500 microns, not greater than 1000 microns, not greater than 900 microns, not greater than 800 microns, not greater than 700 microns, not greater than 500 microns or even not greater than 400 microns. It will be appreciated that the porosity of the body can have a pore size standard deviation within a range including any of the minimum and maximum values noted above.

In another embodiment, the bonded abrasive body can also have a particular pore size variance that can facilitate improved performance of the abrasive article. The pore size variance can be determined from measuring the pore size distribution of the body obtained by a suitable statistical sampling of the body measured using ASTM standard E112 and calculating the variance from the pore size data. For example, the body can have a pore size variance of at least about 10 microns$^2$, such as at least at least 15 microns$^2$, at least 20 microns$^2$, at least 25 microns$^2$, at least 30 microns$^2$, at least 35 microns$^2$ or even at least 40 microns$^2$. Still, in another non-limiting embodiment, the porosity of the body can have a pore size variance of not greater than 1000 microns$^2$, such as not greater than 500 microns$^2$, not greater than 200 microns$^2$, not greater than 100 microns$^2$, not greater than 90 microns$^2$, not greater than 80 microns$^2$ or even not greater than 70 microns$^2$. It will be appreciated that the porosity of the body can have a pore size variance within a range including any of the minimum and maximum values noted above.

According to an embodiment, the bonded abrasive body can also have a particular maximum pore size that can facilitate improved performance of the abrasive article. The maximum pore size can be obtained by a suitable statistical sampling of the body measured using ASTM standard E112 and determining the maximum pore size measured. For example, the body can have a maximum pore size of at least about 590 microns, such as at least at least 600 microns, at least 700 microns, at least 800 microns, at least 900 microns, at least 1000 microns, at least 1200 microns, at least 1500 microns, at least 1700 microns or even at least 2000 microns. Still, in another non-limiting embodiment, the body can have a maximum pore size of not greater than 6000 microns, such as not greater than 5500 microns, not greater than 5000 microns, not greater than 4500 microns, not greater than 4000 microns or even not greater than 3500 microns. It will be appreciated that the body can have a maximum pore size within a range including any of the minimum and maximum values noted above.

In still another instance, the body may include a particular content of abrasive agglomerates 201, which may facilitate improved performance of the abrasive article. For example, the body may include at least 25 vol % abrasive agglomerates for a total volume of the body. In at least one other embodiment, the body can include at least 28 vol %, such as at least 30 vol %, at least 32 vol %, or even at least 34 vol % abrasive agglomerates for a total volume of the body. Still, in at least one non-limiting embodiment, the body may include not greater than 55 vol %, such as not greater than 52 vol %, not greater than 50 vol %, not greater than 48 vol %, not greater than 46 vol %, or even not greater than 44 vol % abrasive agglomerates for a total volume of the body. It will be appreciated that the total content of abrasive agglomerates within the body can be within range including any of the minimum and maximum percentages noted above.

The body of the abrasive article can include a particular content of the total content of all abrasive particles in the body contained within the abrasive agglomerates, which may be suitable for improved formation and performance of the abrasive article. For example, at least 40% of the total content of abrasive particles in the body (i.e., abrasive particles in the abrasive agglomerates and unagglomerated abrasive particles) can be contained within the abrasive agglomerates, such as at least 42%, at least 45%, at least 48%, at least 50%, at least 55%, at least 60%, at least 65%, at least 70%, at least 75%, at least 80%, at least 85%, at least 90%, at least 95% or even 97% of the total content of abrasive particles in the body can be contained within the abrasive agglomerates. Still, in another embodiment, essentially all of the abrasive particles can be contained in the abrasive agglomerates. For yet another non-limiting embodiment, not greater than 97%, such as not greater than 95%, not greater than 90%, not greater than 85%, not greater than 80%, not greater than 75%, not greater than 70%, not greater than 65%, not greater than 60%, not greater than 55%, not greater than 52%, not greater than 50%, not greater than 48%, not greater than 46%, not greater than 44% or even not greater than 42% of the total content of abrasive particles in the body can be contained in the abrasive agglomerates. It will be appreciated that the total content of abrasive particles in the body contained in the abrasive agglomerates can be within a range including any of the minimum and maximum percentages noted above.

In certain instances, the body may be formed to have an abrasive agglomerate content (Caa) as measured by the vol % of abrasive agglomerates relative to the total volume of the body. Moreover, the body can include a bond material content (Cbm) as measured vol % for the total volume of the body. For certain embodiments, the body may have an agglomerate/bond ratio (CBbm/Caa) of at least 2. In other instances, the agglomerate/bond ratio can be at least 2.2, such as at least 2.4, at least 2.6, or even at least 2.8. Still, in another non-limiting embodiment, the agglomerate/bond ratio can be not greater than 12, such as not greater than 11, not greater than 10, or even not greater than 9. It will be appreciated that the agglomerate/bond ratio can be within a range including any of the minimum and maximum values noted above.

In certain instances, the abrasive agglomerates 201 can include a particular content of abrasive particular material, such as silicon carbide. For example, the abrasive agglomerates 201 may include at least 91% silicon carbide for the total content of abrasive particles in the abrasive agglomerates. In yet other instances, the content of silicon carbide in the abrasive agglomerates can be greater, such as at least 92%, at least 93%, at least 94%, at least 95%, at least 96%, at least 97%, at least 98%, or even at least 99% silicon carbide for the total content of abrasive particles in the abrasive agglomerates. In at least one non-limiting embodiment, the abrasive agglomerates include abrasive particles and essentially all of the abrasive particles are silicon carbide. Still, in another non-limiting embodiment, the abrasive agglomerates 201 can include abrasive particles, wherein not greater than 99%, such as not greater than 97%, or even not greater than 95% of the abrasive particles include silicon carbide. It will be appreciated that the abrasive agglomerates can include a content of silicon carbide with a range including any of the minimum and maximum percentages noted above.

Furthermore, at least 91% of the abrasive particles in the entire body may include silicon carbide. In other instances, the content of abrasive particles comprising silicon carbide within the body can be greater, such as at least 92%, at least 93%, at least 94%, at least 95%, at least 96%, at least 97%, at least 98%, or even at least 99% of the abrasive particles in the body can be silicon carbide. In at least one instance, essentially all of the abrasive particles in the body can comprise silicon carbide, and more particularly, essentially all of the abrasive particles in the body can consist essentially of silicon carbide.

In accordance with an embodiment, the abrasive agglomerates may include certain limited contents of other compositions, which may facilitate improved performance of the abrasive article. For example, the abrasive agglomerates may include abrasive particles and such abrasive particles may be essentially free of oxides, nitrides, borides, and a combination thereof. In another instance, the abrasive agglomerates may include abrasive particles including silicon carbide (e.g., Green 39C and Black 37C), brown fused alumina (57A), seeded gel abrasive, sintered alumina with additives, shaped and sintered aluminum oxide, pink alumina, ruby alumina (e.g., 25A and 86A), electrofused monocrystalline alumina 32A, MA88, alumina zirconia abrasives (NZ, NV,ZF), extruded bauxite, cubic boron nitride, diamond, abral (aluminum oxy-nitride), sintered alumina (Treibacher's CCCSK), extruded alumina (e.g., SR1, TG, and TGII), or any combination thereof. Additionally, the abrasive agglomerates can include abrasive particles that may include only carbide-based materials. For example, the abrasive particles of the abrasive agglomerates 201 can include not greater than 9% alumina for a total percentage of the abrasive particles. In another instance, the abrasive agglomerates can include not greater than 7%, such as not to than 5%, not greater than 3%, or even not greater than 2% alumina for the total percentage of abrasive particles in the abrasive agglomerates. In at least one embodiment, the abrasive particles of the abrasive agglomerates 201 can be essentially free of alumina, and more particularly, may be essentially free of alpha alumina. Moreover, it will be appreciated that in certain instances, the body of the bonded abrasive may be essentially free of alpha alumina.

In certain instances, the body of the abrasive article can have a limited content of unagglomerated abrasive particles comprising alumina. For example, the body can include not greater than 9% alumina-containing unagglomerated abrasive particles for a total percentage of the abrasive particles in the body. In another instance, the body can include not greater than 7%, such as not to than 5%, not greater than 3%, or even not greater than 2% alumina-containing unagglomerated abrasive particles for the total percentage of abrasive particles in the body. In at least one embodiment, the body can be essentially free of alumina, and more particularly, may be essentially free of alpha alumina abrasive particles, including unagglomerated particles containing alpha alumina.

For certain embodiments, the abrasive article may include some content of unagglomerated abrasive particles in addition to the abrasive agglomerates. For example, the content of unagglomerated abrasive particles (Cuap) can be less than a content of abrasive agglomerates (Caa). Notably, the abrasive article can have a ratio (Cuap/Caa) of a content of unagglomerated abrasive particles (Cuap) as measured in volume percent of the entire volume of the body compared to a content of abrasive agglomerates (Caa) as measured in volume percent for the entire volume of the body. In one embodiment, the ratio (Cuap/Caa) can be not greater than 1.5, such as not greater than 1.4, not greater than 1.3, not greater than 1.2, not greater than 1.15, not greater than 1.12, not greater than 1.1, not greater than 1.08, not greater than 1.06, not greater than 1.04, not greater than 1.02, not greater than 1, not greater than 0.98, not greater than 0.95, not greater than 0.9, not greater than 0.85, not greater than 0.8, not greater than 0.75, not greater than 0.7, not greater than 0.65, not greater than 0.6, not greater than 0.55, not greater than 0.5, not greater than 0.45, not greater than 0.4, not greater than 0.35, not greater than 0.3, not greater than 0.25, not greater than 0.2, not greater than 0.15, not greater than 0.1, not greater than 0.08, not greater than 0.06, not greater than 0.05, not greater than 0.04, not greater than 0.03, not greater than 0.02 or even not greater than 0.01. Still, in at least one particular embodiment, the body can have a ratio (Cuap/Caa) of at least 0.01, such as at least 0.02, at least 0.03, at least 0.04, at least 0.05, at least 0.06, at least 0.07, at least 0.08, at least 0.09, at least 0.1, at least 0.12, at least 0.15, at least 0.18, at least 0.2, at least 0.22, at least 0.25, at least 0.28, at least 0.3, at least 0.32, at least 0.35, at least 0.38, at least 0.4, at least 0.45, at least 0.5, at least 0.55, at least 0.6, at least 0.65, at least 0.7, at least 0.75, at least 0.8, at least 0.85, at least 0.9, at least 0.95, at least 0.98. It will be appreciated that the ratio (Cuap/Caa) can be within a range including any of the minimum and maximum values noted herein.

According to a particular embodiment, the unagglomerated abrasive particles may be present in an amount of at least about 1 vol % for a total volume of the body, such as at least 2 vol %, at least 3 vol %, at least 4 vol %, even at least 5 vol %, at least 6 vol %, at least 7 vol %, at least 8 vol %, even at least 9 vol %, at least 10 vol %. In yet another embodiment, the unagglomerated abrasive particles can be present in an amount of not greater than 30 vol % for a total volume of the body, such as not greater than 28 vol %, not greater than 26 vol %, not greater than 24 vol %, not greater than 22 vol %, not greater than 20 vol %, not greater than 18 vol %, not greater than 16 vol %, not greater than 14 vol %, not greater than 12 vol %, not greater than 10 vol %, not greater than 8 vol %, not greater than 6 vol %. For certain abrasive articles, the unagglomerated abrasive particles may be present in an amount within a range including any of the minimum and maximum values noted above. Still, in one particular embodiment, the total content of abrasive particles in the body can consist essentially of abrasive agglomerates and may be essentially free of unagglomerated abrasive particles.

The bonded abrasive body of the embodiments herein may have a particular permeability and porosity that can facilitate improved performance of the abrasive article. For example, the body may include porosity, wherein at least 20% of the total porosity of the body can be interconnected porosity. Interconnected porosity defines a series of interconnected channels extending through the body. Interconnected porosity may also be referred to herein as open porosity. Open porosity or interconnected porosity can be distinct from closed porosity, which is defined as discrete pores within the body that are not connected to adjacent pores and do not form an interconnected network of channels through the body. Closed porosity does not allow a fluid to flow freely through the volume of the body. In another instance, the body can include at least 30%, such as at least 40%, at least 50%, at least 60%, at least 70%, at least 80%, at least 90%, or even at least 95% interconnected porosity for the total volume or porosity in the body. In at least one embodiment, essentially all the porosity of the body can be interconnected porosity. Still, in at least one non-limiting embodiment, the body can have not greater than 99%, such as not greater than 95%, or even not greater than 90% of the total porosity may be interconnected porosity. It will be appreciated that the body can include a content of interconnected porosity within a range including any of the minimum and maximum values noted above.

In accordance with another embodiment, the bonded abrasive bodies herein may have a particular content of permeability as measured by the average Darcy's number, which may facilitate improved performance of the abrasive article. In accordance with an embodiment, the body can have a permeability of at least 60. In other instances, the permeability may be greater, such as at least 65, at least 70, at least 80, at least 90, at least 100, at least 110, at least 115, at least 120, or even at least 125. Still, in at least one non-limiting embodiment, the permeability of the bonded abrasive body may be not greater than 300, such as not greater than 250, or not greater than 200. It will be appreciated that the bonded abrasive body may have a permeability within a range including any of the minimum and maximum values noted above.

Darcy's number is measured according to an air permeability test, as detailed in ASTM C577 and developed by subcommittee and published at C08.03 Book of Standards Volume: 15.01. A sample is installed dry into a Gas Permeameter GP-100A from PMI Inc. of Ithaca, N.Y. The sample has a flat surface and thickness of 1.27 cm. The diameter of the O-ring which holds the sample determines the sample diameter, which is 1.07 cm. Air is forced to flow through the test sample at room temperature. A range of different pressure differentials from 0 to 3 psi are applied to the surface of the sample and the flow of the air through the sample is measured. The measurements of flow rate and the corresponding pressure drops (differential pressure) for the range of pressures from 0 to 3 psi is used to calculate the the average Darcy's number, which defines the permeability of the bonded abrasive body.

Darcy's number (C) is calculated according to the equation $C=(8FTV)/[\pi D^2(P^2-1)]$, and defines the permeability through a porous medium, where "F" represents the flow, "T" represents the sample thickness (i.e., 1.27 cm), "V" represents the viscosity of the gas flowing through the sample (i.e., air having a viscosity of 0.0185 mPa s) "D" represents the diameter of the sample (i.e., 1.07 cm), "P" represents the pressure gradient across the sample thickness.

In certain instances, the bonded abrasive bodies of the embodiments herein can have a certain pore size distribution that defines a primary pore size maxima. For example, referring to FIG. 3 a plot of volume percent to pore diameter is provided to illustrate an exemplary pore size distribution curve. As further illustrated in the plot of FIG. 3, the primary pore size maxima 301 is the maxima associated with the highest peak (i.e., mode) on the pore size distribution curve. For the plot of FIG. 3, the primary pore size maxima 301 has a value of "W" as it is the point on the pore size distribution curve defining a maxima associated with the primary pore size as defined by the greatest volume percent value "Y". A maxima is a point on the curve having a slope of zero between a portion of the curve to the left of the maxima having a positive slope and a portion of the curve to the right of the maxima having a negative slope value.

In accordance with an embodiment, the bonded abrasive body can have a primary pore size maxima of at least 180 microns. In other embodiments, the primary pore size maxima can be at least 185 microns, such as least 190 microns, at least 200 microns, at least 205 microns, at least 210 microns, at least 215 microns, or even at least 220 microns. Still, in a non-limiting embodiment, the bonded abrasive body may have a primary pore size maxima of not greater than 700 microns, such as not greater than 600 microns, not great 500 microns, or not greater than about 450 microns. It will be appreciated that the primary pore size maxima can be within a range including any of the minimum and maximum values noted above.

Figure 3:
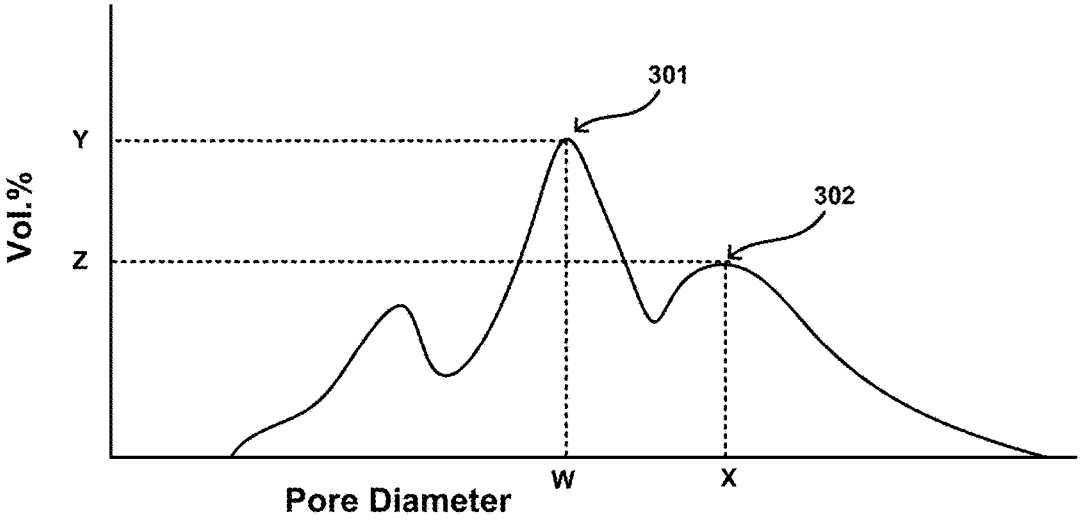
FIG. 3 includes an exemplary pore size distribution curve.

Is further illustrated in FIG. 3, the pore size distribution plot may also include a secondary pore size maxima 302. The secondary pore size maxima 302 can be defined by the second highest peak on the pore size distribution curve. Stated alternatively, the secondary pore size maxima 302 can be a pore diameter value "X" associated with the maxima on the pore size distribution curve having the second highest volume percent value "Z".

In accordance with an embodiment, the bonded abrasive body can have a secondary pore size maxima of at least 180 microns. In other instances, the secondary pore size maxima of the bonded abrasive body can be at least 185 microns, at least 190 microns, at least 200 microns, at least 210 microns, at least 220 microns, at least 230 microns, at least 240 microns, at least 250 microns, at least 260 microns, at least 270 microns, or even at least 280 microns. Still, in one non-limiting embodiment, the bonded abrasive body can have a secondary pore size maxima of not greater than 700 microns, such as not greater than 600 microns, not greater than 500 microns, or even not greater than 450 microns. It will be appreciated that the secondary pore size maxima can be within a range including any of the minimum and maximum values noted above.

In certain instances, the bonded abrasive body can have a primary pore size maxima (PSpm) in a secondary pore size maxima (PSsm), notably the secondary pore size maxima can be different than the primary pore size maxima. For example referring again to FIG. 3, the primary pore size maxima 301 has a value of "W," wherein the secondary pore size maxima 302 has a value of X. In more particular instances, the bonded abrasive body may be formed such that the secondary pore size maxima is greater in value than the primary pore size maxima. Referring again to FIG. 3, the secondary pore size maxima 302 can have a value of "X," which is greater than the value of "W" associated with the primary pore size maxima 301.

In at least one particular embodiment, the bonded abrasive body can have a pore size maxima ratio (PSpm/PSsm), wherein the pore size maxima ratio can be not greater than 1. In other instances, the pore size maxima ratio can be not greater than 0.98, such as not greater than 0.95, not greater than 0.9, not greater than 0.85, not greater than 0.8, not greater than 0.7, not greater than 0.6, or even not greater than 0.5. Still, and at least one non-limiting embodiment, the bonded abrasive body can have a pore size maxima ratio of at least 0.1, such as at least 0.2, at least 0.25, at least 0.3, at least 0.35, or even at least 0.4. It will be appreciated that the bonded abrasive body can have a pore size maxima ratio within range including any of the minimum and maximum values noted above.

In certain instances, the bonded abrasive body may include a content of ceramic pore formers contained within the bond material. Notably, the bonded abrasive bodies herein can have a significant degree of porosity and permeability, and yet have a significantly low content of ceramic pore forming materials. For example, the body may include a ceramic pore former present in an amount of not greater than about 5 vol % for a total volume of the body. In other instances, the content of the ceramic pore former may be less, such as not greater than 4.5 vol %, such as not greater than 4 vol %, not greater than 3.5 vol %, not greater than 3 vol %, not greater than 2.5 vol %, not greater than 2 vol %, not greater than 1.5 vol %, not greater than 1 vol %, or even not greater than 0.5 vol % for the total volume of the body. In at least one instance, the body may be essentially free of a ceramic pore former, or any pore forming material. Still, in another non-limiting embodiment, the bonded abrasive body may include a minimum content of a pore former, such as a ceramic pore former, such that the body can include at least 0.2 vol %, such as at least 0.5 vol %, at least 0.8 vol %, or even at least 1 vol % of a pore former, such as ceramic pore former, for the total volume of the body. It will be appreciated that the body may include a content of a pore former within a range including any of the minimum and maximum percentages noted above.

In accordance with one embodiment, the bond material of the bonded abrasive body may include a particular content of silica ($SiO_2$ or silicon dioxide) for a total weight of the bond material, which may facilitate suitable performance of the abrasive article. For example, the bonded abrasive body may include at least 30 wt % silica, such as at least 32 wt %, at least 34 wt %, at least 36 wt %, at least 37 wt %, at least 40 wt %, at least 42 wt %, or even at least 45 wt % silica for a total weight of the bond material. Still, in at least one non-limiting embodiment, the bond material of the bonded abrasive body can include not greater than 60 wt % silica, such as not greater than 58 wt %, not greater than 55 wt %, not greater than 52 wt %, not greater than 50 wt %, not greater than 49 wt %, not greater than 48 wt %, not greater than 47 wt %, not greater than 46 wt %, or even not greater than 45 wt % silica for a total weight of the bond material. It will be appreciated that the content of silica within the bond can be within a range including any of the minimum and maximum percentages noted above.

Additionally, the bond material of bonded abrasive body may include a particular content of alumina ($Al_2O_3$ or aluminum oxide) for a total weight of the bond material that may facilitate improved performance of the abrasive article. For example, the bond material of the bonded abrasive body may include at least 4 wt %, such as at least 5 wt %, at least 6 wt %, at least 7 wt %, at least 8 wt %, at least 9 wt %, at least 10 wt %, or even at least 11 wt % alumina for total weight of the bond material. Still, in one non-limiting embodiment, the bond material of the bonded abrasive body may include not greater than 18 wt %, such as not greater than 16 wt %, not greater than 15 wt %, not greater than 14 wt %, not greater than 13 wt %, or even not greater than 12 wt % alumina for the total weight of the bond material. It will be appreciated that the content of alumina within the bond material may be within range between any of the minimum and maximum percentages noted above.

In at least one embodiment, the bond material may include a particular content of aluminum and alumina that can facilitate formation and improved performance of the abrasive article. For example, the bond material can include at least 4 wt % alumina and aluminum metal ($Al_2O_3$/Al) for a total weight of the bond material. In still other instances, the bond material can include at least 5 wt %, such as at least 6 wt % or even at least 7 wt % alumina and aluminum metal ($Al_2O_3$/Al) for a total weight of the bond material. In another non-limiting embodiment, the bond material can include not greater than 22 wt %, such as not greater than 21 wt %, not greater than 20 wt %, not greater than 19 wt %, not greater than 18 wt %, not greater than 17 wt %, not greater than 16 wt %, or even not greater than 15 wt % alumina and aluminum metal for a total weight of the bond material. It will be appreciated that the bond material can include a content of alumina and aluminum metal within a range including any of the minimum and maximum values noted above.

For at least one embodiment, the bond material may include a particular ratio of a content of silica (wt % for a total weight of the bond material) relative to a content of aluminum and alumina (wt % for a total weight of the bond material) that can facilitate formation and improved performance of the abrasive article. For example, the bond material can include a ratio ($SiO_2$/($Al_2O_3$ and Al)) of at least 2, such as at least 2.1, at least 2.2, at least 2.3, at least 2.4, or even at least 2.5. In another non-limiting embodiment, the bond material can include a ratio ($SiO_2$/($Al_2O_3$ and Al)) of not greater than 9, such as not greater than 8.8, not greater than 8.5, not greater than 8.2, not greater than 8.1, not greater than 8, or even not greater than 7.9. It will be appreciated that the bond material can include have a ratio of ($SiO_2$/($Al_2O_3$ and Al)) within a range including any of the minimum and maximum values noted above.

The bond material may include a particular content of calcia (CaO or calcium oxide) that may facilitate improved performance. For example, the bond material may include not greater than 8 wt %, not greater than 6 wt %, not greater than 5 wt %, not greater than 4 wt %, not greater than 3 wt %, or even not greater than 2 wt % calcia for a total weight of the bond material. Still, for at least one non-limiting embodiment, the bond material may include at least 0.1 wt %, such as at least 0.5 wt %, at least 0.8 wt %, or even at least 1 wt % calcia for a total weight of the bond material. It will be appreciated that the content of calcia within the bond material can be within a range including any of the minimum and maximum percentages noted above.

According to an exemplary embodiment, the bond material may be essentially free of calcia. Moreover, in other instances, the bond material may be essentially free of rare earth oxides. Still, in at least one embodiment, the bond material may be essentially free of alkali earth metal oxides except for calcia (CaO). In yet another instance, the bond material can be essentially free of a metal, and more particularly may be essentially free of alumina metal. Moreover, the bond material may be essentially free of other elements and compounds including for example magnesium oxide (MgO) potassium oxide ($K_2O$), iron oxide ($Fe_2O_3$), and titanium dioxide ($TiO_2$). Additionally, the bond material can be essentially free of a polymer, including for example, a resin material, a thermoplastic material, a thermoset material, and a combination thereof. A compound that is considered essentially free is reference to a content of less than 1 wt %, and may be less than 0.1 wt % for the total weight of the bond material.

In accordance with an embodiment, the bond material can include a particular content of boron oxide ($B_2O_3$) that may facilitate formation of the abrasive article and improve performance. For example, the bond material may include at least 5 wt %, such as at least 6 wt %, at least 7 wt %, at least 8 wt %, or even at least 9 wt % boron oxide for a total weight of the bond material. Still, in at least one non-limiting embodiment, the bond material may include not greater than 24 wt %, such as not greater than 22 wt %, not greater than 20 wt %, not greater than 18 wt %, not greater than 17 wt %, or even not greater than 16 wt % boron oxide for a total weight of the bond material. It will be appreciated that the bond material can include a content of boron oxide within range including any of the minimum and maximum percentages noted above.

According to another embodiment, the bond material may include a particular ratio of a content of silica (wt % for a total weight of the bond material) relative to a content of boron oxide (wt % for a total weight of the bond material) that can facilitate formation and improved performance of the abrasive article. For example, the bond material can include a ratio ($SiO_2/B_2O_3$) of at least 1.5, such as at least 1.7, at least 1.9, at least 2, at least 2.1, at least 2.2, or even at least 2.3. In another non-limiting embodiment, the bond material can include a ratio ($SiO_2/B_2O_3$) of not greater than 8, such as not greater than 7.8, not greater than 7.4, not greater than 7.2, not greater than 6.9, not greater than 6.8, not greater than 6.6, not greater than 6.4, not greater than 6.3, or even not greater than 6.2. It will be appreciated that the bond material can have a ratio ($SiO_2/B_2O_3$) within a range including any of the minimum and maximum values noted above.

In still other instances, bond material can include other species, including for example sodium oxide ($Na_2O$), which may facilitate improved manufacturing and performance of the abrasive article. For example, the bond material can include at least 0.5 wt %, such as at least 1 wt %, at least 2 wt %, at least 2.5 wt %, at least 3 wt %, at least 3.5 wt %, at least 4 wt %, at least 4.2 wt % or even at least 4.4 wt % sodium oxide for a total weight of the bond material. In yet another non-limiting embodiment, the bond material may include not greater than 15 wt %, such as not greater than 12%, not greater than 10 wt %, not greater than 9 wt %, not or than 8 wt %, not greater than 7 wt %, not greater than 6 wt % or even not greater than 5.8 wt % sodium oxide for a total weight of the bond material. It will be appreciated that the bond material can include a content of sodium oxide within a range including any of the minimum and maximum percentages noted above.

For certain compositions of the embodiments herein, the bond material can be essentially free of alkali metal oxide compounds. However, in at least one embodiment the bond material can be essentially free of alkali metal oxides except for sodium oxide.

According to another embodiment, the bond material may include a particular ratio of a content of silica (wt % for a total weight of the bond material) relative to a content of sodium oxide (wt % for a total weight of the bond material) that can facilitate formation and improved performance of the abrasive article. For example, the bond material can include a ratio ($SiO_2/Na_2O$) of at least 2, such as at least 2.5, at least 3, at least 3.5, at least 4, or even at least 4.5. In another non-limiting embodiment, the bond material can include a ratio ($SiO_2/Na_2O$) of not greater than 30, such as not greater than 28, not greater than 26, not greater than 24, not greater than 22, not greater than 20, not greater than 19, or even not greater than 18.5. It will be appreciated that the bond material can have a ratio ($SiO_2/Na_2O$) within a range including any of the minimum and maximum values noted above.

As noted herein the bond material can include a ceramic material. The ceramic material can include a vitreous phase, a polycrystalline phase, and any combination thereof. In at least one embodiment, the bond material includes a vitreous phase and a polycrystalline phase. The polycrystalline phase can include a silica-containing compound, and more particularly, a zirconium-containing compound. In at least one embodiment, the polycrystalline phase can include zircon ($ZrSiO_4$). For example, the bond material can include at least 15 wt %, such as at least 17 wt %, at least 19 wt %, at least 20 wt %, at least 21 wt %, at least 22 wt %, at least 23 wt %, or even at least 24 wt % zircon for a total weight of the bond material. However, in another non-limiting embodiment, the bond material may include not greater than 44 wt %, not greater than 42 wt %, not greater than 40 wt %, not greater than 38 wt %, not greater than 36 wt %, not greater than 35 wt %, not greater than 34 wt %, not greater than 33 wt %, or even not greater than 32 wt % zircon for a total weight of the bond material. It will be appreciated that the bond material can include a content of zircon within a range including any of the minimum and maximum percentages noted above.

According to another embodiment, the bond material may include a particular ratio of a content of silica (wt % for a total weight of the bond material) relative to a content of zircon (wt % for a total weight of the bond material) that can facilitate formation and improved performance of the abrasive article. For example, the bond material can include a ratio ($SiO_2/ZrSiO_4$) of at least 1, such as at least 1.05 or even at least 1.10. In another non-limiting embodiment, the bond material can include a ratio ($SiO_2/ZrSiO_4$) of not greater than 3, such as not greater than 2.8, not greater than 2.6, not greater than 2.4, not greater than 2.2, not greater than 2 or even not greater than 1.9. It will be appreciated that the bond material can have a ratio ($SiO_2/ZrSiO_4$) within a range including any of the minimum and maximum values noted above.

In certain instances, the bond material may include a mixture of a ceramic material and a metal material. The metal material can include aluminum, and in at least one embodiment, may consist essentially of aluminum. According to at least one embodiment, the metal material can be present within the bond material in a minority content, and notably in a content less than the content of the ceramic material. For example, the metal material can be present in an amount of not greater than 10 wt % for the total weight of the bond. In yet another embodiment, the metal material can be present in an amount of not greater than 9 wt %, not greater than 8 wt %, not greater than 7 wt %, not greater than 6 wt %, not greater than 5 wt %, 4.5 wt %, such as not greater than 4 wt %, not greater than 3.5 wt %, not greater than 3 wt % or even not greater than 2.5 wt % for a total weight of the bond. Still, in at least one non-limiting embodiment, the metal material can be present in an amount of at least 0.3 wt %, such as at least 0.5 wt %, at least 0.8 wt % or even at least 1 wt % for a total weight of the bond. It will be appreciated that the bond material can include a content of metal material within a range including any of the minimum and maximum values noted above.

Item 1. An abrasive article comprising: a body including: a bond material comprising an inorganic material comprising a ceramic; abrasive agglomerates comprising silicon carbide contained within the bond material; and a permeability of at least 60.

Item 2. An abrasive article comprising: a body including: a bond material comprising an inorganic material comprising a ceramic; abrasive agglomerates comprising silicon carbide contained within the bond material; a ceramic pore former contained within the bond material, the ceramic pore former present in an amount of not greater than 5 vol % for a total volume of the body; and a porosity of at least 40 vol % for the total volume of the body.

Item 3. An abrasive article comprising: a body including: a bond material comprising an inorganic material comprising a ceramic; abrasive agglomerates contained within the bond material comprising silicon carbide particles; a porosity of at least 40 vol % for a total volume of the body; and a permeability of at least 60.

Item 4. An abrasive article comprising: a body including: a bond material comprising an inorganic material comprising a ceramic; abrasive agglomerates comprising silicon carbide contained within the bond material; and an average pore size of at least 70 microns.

Item 5. An abrasive article comprising: a body including: a bond material comprising an inorganic material comprising a ceramic; abrasive agglomerates comprising silicon carbide contained within the bond material; and a median pore size of at least 45 microns.

Item 6. An abrasive article comprising: a body including: a bond material comprising an inorganic material comprising a ceramic; abrasive agglomerates comprising silicon carbide contained within the bond material; and an upper quartile pore size limit of at least 85 microns.

Item 7. An abrasive article comprising: a body including: a bond material comprising an inorganic material comprising a ceramic; abrasive particles comprising silicon carbide contained within the bond material; and an average pore size of at least 70 microns and a pore size standard deviation of at least 77 microns.

Item 8. An abrasive article comprising: a body including: a bond material comprising an inorganic material comprising a ceramic; abrasive particles comprising silicon carbide contained within the bond material; and an average pore size of at least 70 microns and a pore size variance of at least 10 $microns^2$.

Item 9. The abrasive article of any of items 1, 2, 3, 4, 5, 6, 7, and 8, wherein the body comprises at least 3 vol % bond material for a total volume of the body or at least 4 vol % or at least 5 vol %.

Item 10. The abrasive article of any of items 1, 2, 3, 4, 5, 6, 7, and 8, wherein the body comprises not greater than 20 vol % bond material for a total volume of the body or not greater than 18 vol % or not greater than 15 vol % or not greater than 12 vol %.

Item 11. The abrasive article of any of items 1, 4, 5, 6, 7, and 8, wherein the body comprises at least 40 vol % porosity for a total volume of the body.

Item 12. The abrasive article of any of items 3, 4, and 11, wherein the body comprises at least 42 vol % porosity for a total volume of the body or at least 43 vol % or at least 44 vol % or at least 45 vol % or at least 46 vol % or at least 47 vol % or at least 48 vol % or at least 49 vol % or at least 50 vol % or at least 51 vol % or at least 52 vol % or at least 53 vol % or at least 54 vol %.

Item 13. The abrasive article of any of items 3, 4, and 11, wherein the body comprises not greater than 75 vol % porosity for a total volume of the body or not greater than 70 vol % or not greater than 68 vol % or not greater than 65 vol % or not greater than 63 vol % or not greater than 60 vol %.

Item 14. The abrasive article of any of items 1, 2, 3, 4, 5, 6, 7, and 8, wherein the body comprises at least 25 vol % abrasive agglomerates for a total volume of the body or at least 28 vol % or at least 30 vol % or at least 32 vol % or at least 34 vol %.

Item 15. The abrasive article of any of items 1, 2, 3, 4, 5, 6, 7, and 8, wherein the body comprises not greater than 55 vol % abrasive agglomerates for a total volume of the body or not greater than 52 vol % or not greater than 50 vol % or not greater than 48 vol % or not greater than 46 vol % or not greater than 44 vol %.

Item 16. The abrasive article of any of items 1, 2, 3, 4, 5, 6, 7, and 8, wherein the body comprises an abrasive agglomerates content (Caa) and a bond material content (Cbm) as measured in vol % for a total volume of the body, and wherein the body comprises an agglomerates/bond ratio (Cbm/Caa) of at least 2 or at least 2.2 or at least 2.4 or at least 2.6 or at least 2.8.

Item 17. The abrasive article of item 16, wherein the agglomerates/bond ratio (Cbm/Caa) is not greater than 12 or not greater than 11 or not greater than 10 or not greater than 9.

Item 18. The abrasive article of any of items 1, 2, 3, 4, 5, 6, 7, and 8, wherein the abrasive agglomerates comprises at least 91% silicon carbide for the total content of abrasive particles in the agglomerates or at least 92% or at least 93% or at least 94% or at least 95% or at least 96% or at least 97% or at least 98% or at least 99%.

Item 19. The abrasive article of any of items 1, 2, 3, 4, 5, 6, 7, and 8, wherein the abrasive agglomerates include abrasive particles and essentially all of the abrasive particles are silicon carbide.

Item 20. The abrasive article of any of items 1, 2, 3, 4, 5, 6, 7, and 8, wherein at least at least 91% of the abrasive particles in the body comprise silicon carbide or at least 92% or at least 93% or at least 94% or at least 95% or at least 96% or at least 97% or at least 98% or at least 99%.

Item 21. The abrasive article of any of items 1, 2, 3, 4, 5, 6, 7, and 8, wherein the abrasive agglomerates comprise abrasive particles and the abrasive particles comprise not greater than 9% alumina for a total percentage of abrasive particles in the body or not greater than 7% or not greater than 5% or not greater than 3% or not greater than 2%.

Item 22. The abrasive article of any of items 1, 2, 3, 4, 5, 6, 7, and 8, wherein the body comprises comprise not greater than 9% alumina-containing unagglomerated abrasive particles for a total percentage of abrasive particles in the body or not greater than 7% or not greater than 5% or not greater than 3% or not greater than 2%.

Item 23. The abrasive article of any of items 1, 2, 3, 4, 5, 6, 7, and 8, wherein the abrasive agglomerates comprise abrasive particles and the abrasive particles are essentially free of alumina.

Item 24. The abrasive article of any of items 1, 2, 3, 4, 5, 6, 7, and 8, wherein the body is essentially free of alpha alumina.

Item 25. The abrasive article of any of items 1, 2, 3, 4, 5, 6, 7, and 8, wherein the abrasive agglomerates comprise abrasive particles and wherein the abrasive particles comprise only carbide-based materials.

Item 26. The abrasive article of any of items 1, 2, 3, 4, 5, 6, 7, and 8, wherein the abrasive agglomerates comprise abrasive particles and wherein the abrasive particles are essentially free of oxides, nitrides, borides, and a combination thereof.

Item 27. The abrasive article of any of items 1, 2, 3, 4, 5, 6, 7, and 8, wherein the body further comprises unagglomerated abrasive particles.

Item 28. The abrasive article of item 27, wherein the content of unagglomerated abrasive particles (Cuap) is different than a content of abrasive agglomerates (Caa).

Item 29. The abrasive article of item 28, wherein the body comprises a ratio (Cuap/Caa) of a content of unagglomerated abrasive particles (Cuap) compared to a content of abrasive agglomerates (Caa) of not greater than 1.5 or not greater than 1.4 or not greater than 1.3 or not greater than 1.2 or not greater than 1.15 or not greater than 1.12 or not greater than 1.1 or not greater than 1.08 or not greater than 1.06 or not greater than 1.04 or not greater than 1.02 or not greater than 1 or not greater than 0.98 or not greater than 0.95 or not greater than 0.9 or not greater than 0.8 or not greater than 0.75 or not greater than 0.7 or not greater than 0.65 or not greater than 0.6 or not greater than 0.55 or not greater than 0.5 or not greater than 0.45 or not greater than 0.4 or not greater than 0.35 or not greater than 0.3 or not greater than 0.25 or not greater than 0.2 or not greater than 0.15 or not greater than 0.1 or not greater than 0.08 or not greater than 0.06 or not greater than 0.05 or not greater than 0.04 or not greater than 0.03 or not greater than 0.02 or not greater than 0.01.

Item 30. The abrasive article of item 28, wherein the body comprises a ratio (Cuap/Caa) of a content of unagglomerated abrasive particles (Cuap) compared to a content of abrasive agglomerates (Caa) of at least 0.01 or at least 0.02 or at least 0.03 or at least 0.04 or at least 0.05 or at least 0.06 or at least 0.07 or at least 0.08 or at least 0.09 or at least 0.1.

Item 31. The abrasive article of item 27, wherein the unagglomerated abrasive particles are selected from the group of materials consisting of oxides, carbides, nitrides, borides, carbon-based materials, oxycarbides, oxynitrides, oxyborides, and a combination thereof.

Item 32. The abrasive article of item 27, wherein the unagglomerated abrasive particles comprise a superabrasive material.

Item 33. The abrasive article of item 27, wherein the unagglomerated abrasive particles have a Mohs harndess of at least 6 or at least 6.5 or at least 7 or at least 8 or at least 8.5 or at least 9.

Item 34. The abrasive article of item 27, wherein the unagglomerated abrasive particles include a material selected from the group consisting of silicon dioxide, silicon carbide, alumina, zirconia, flint, garnet, emery, rare earth oxides, rare earth-containing materials, cerium oxide, sol-gel derived particles, gypsum, iron oxide, glass-containing particles, and a combination thereof.

Item 35. The abrasive article of item 27, wherein the unagglomerated abrasive particles consist essentially of silicon carbide.

Item 36. The abrasive article of item 27, wherein the unagglomerated abrasive particles are present in an amount of at least about 1% for a total content of abrasive particles in the body or at least at least 2% or at least 5% or at least 8% or at least 10% or at least 15% or at least 20% or at least 25% or at least 30% or at least 35% or at least 40% or at least 45% or at least 50% of the total content of abrasive particles.

Item 37. The abrasive article of item 27, wherein the unagglomerated abrasive particles are present in an amount of not greater than 60% or not greater than 55% or not greater than 50% or not greater than 45% or not greater than 40% or not greater than 35% or not greater than 30% or not greater than 25% or not greater than 20% or not greater than 15% or not greater than 12% or not greater than 10% or not greater than 8% or not greater than 6% or not greater than 4% or not greater than 2% or not greater than 1% for a total content of abrasive particle in the body.

Item 38. The abrasive article of item 27, wherein the unagglomerated abrasive particles comprise an average particle size (D50) of at least 1 micron or at least 5 microns or at least 10 microns, or at least 20 microns or at least 30 microns or at least 40 microns or at least 50 microns.

Item 39. The abrasive article of item 27, wherein the unagglomerated abrasive particles comprise an average particle size (D50) of not greater than 2600 microns or not greater than 2000 microns or not greater than 1000 microns or not greater than 800 microns or not greater than 600 microns or not greater than 300 microns or not greater than 200 microns, or not greater than 150 micron or not greater than 100 microns.

Item 40. The abrasive article of item 27, wherein the unagglomerated abrasive particles comprise an average particle size (D50) less than an average particle size (D50) of the agglomerated abrasive particles.

Item 41. The abrasive article of any of items 1, 2, 3, 4, 5, 6, 7, and 8, wherein the total content of abrasive particles in the body consists essentially of abrasive agglomerates and is essentially free of unagglomerated abrasive particles.

Item 42. The abrasive article of any of items 1, 2, 3, 4, 5, 6, 7, and 8, wherein the body comprises porosity and at least 20% of the total porosity is interconnected porosity or at least 30% or at least 40% or at least 50% or at least 60% or at least 70% or at least 80% or at least 90% or at least 95%.

Item 43. The abrasive article of item 42, wherein essentially all of the porosity of the body is interconnected porosity.

Item 44. The abrasive article of any of items 1, 2, 3, 4, 5, 6, 7, and 8, wherein the body comprises porosity and not greater than 99% of the total porosity is interconnected porosity or not greater than 95% or not greater than 90%.

Item 45. The abrasive article of any of items 2, 4, 5, 6, 7, and 8, wherein the body comprises a permeability of at least 60.

Item 46. The abrasive article of any of items 1, 3, and 45, wherein the body comprises a permeability of at least 65 or at least 70 or at least 80 or at least 90 or at least 100 or at least 110 or at least 115 or at least 120 or at least 125.

Item 47. The abrasive article of any of items 1, 3, and 45, wherein the body comprises a permeability of not greater than 300 or not greater than 250 or not greater than 200.

Item 48. The abrasive article of any of items 1, 2, 3, 4, 5, 6, 7, and 8, wherein the body comprises a ceramic pore former contained within the bond material, the ceramic pore former present in an amount of not greater than 5 vol % for a total volume of the body.

Item 49. The abrasive article of any of items 4 and 48, wherein the body comprises a ceramic pore former contained within the bond material present in an amount of not greater than 4.5 vol % or not greater than 4 vol % or not greater than 3.5 vol % or not greater than 3 vol % or not greater than 2.5 vol % or not greater than 2 vol % or not greater than 1.5 vol % or not greater than 1 vol % or not greater than 0.5 vol %

Item 50. The abrasive article of any of items 4 and 48, wherein the body is essentially free of a pore former.

Item 51. The abrasive article of any of items 4 and 48, wherein the body comprises at least 0.2 vol % of the ceramic pore former or at least 0.5 vol % or at least 0.8 vol % or at least 1 vol %.

Item 52. The abrasive article of any of items 1, 2, 3, 4, 5, 6, 7, and 8, wherein the bond material comprises a forming temperature of not greater than about 950° C.

Item 53. The abrasive article of any of items 1, 2, 3, 4, 5, 6, 7, and 8, wherein the bond material comprises at least 30 wt % silica ($SiO_2$) for a total weight of the bond material or at least 32 wt % or at least 34 wt % or at least 36 wt % or at least 37 wt %.

Item 54. The abrasive article of any of items 1, 2, 3, 4, 5, 6, 7, and 8, wherein the bond material comprises not greater than 60 wt % or not greater than 58 wt % or not greater than 55 wt % silica.

Item 55. The abrasive article of any of items 1, 2, 3, 4, 5, 6, 7, and 8, wherein the bond material comprises at least 4 wt % alumina ($Al_2O_3$) for a total weight of the bond material or at least 5 wt % or at least 6 wt % or at least 7 wt % or at least 8 wt % or at least 9 wt % or at least 10 wt % alumina ($Al_2O_3$).

Item 56. The abrasive article of any of items 1, 2, 3, 4, 5, 6, 7, and 8, wherein the bond material comprises not greater than 18 wt % alumina for a total weight of the bond material or not greater than 16 wt % or not greater than 15 wt % or not greater than 14 wt % or not greater than 13 wt % or not greater than 12 wt %.

Item 57. The abrasive article of any of items 1, 2, 3, 4, 5, 6, 7, and 8, wherein the bond material comprises at least 4 wt % alumina and aluminum metal ($Al_2O_3$/Al) for a total weight of the bond material or at least 5 wt % or at least 6 wt % or at least 7 wt %.

Item 58. The abrasive article of any of items 1, 2, 3, 4, 5, 6, 7, and 8, wherein the bond material comprises not greater than 18 wt % alumina and aluminum metal for a total weight of the bond material or not greater than 16 wt % or not greater than 15 wt % or not greater than 14 wt % or not greater than 13 wt % or not greater than 12 wt %.

Item 59. The abrasive article of any of items 1, 2, 3, 4, 5, 6, 7, and 8, wherein the bond material comprises a ratio ($SiO_2$/($Al_2O_3$ and Al)) of at least 2 or at least 2.1 or at least 2.2 or at least 2.3 or at least 2.4 or at least 2.5.

Item 60. The abrasive article of any of items 1, 2, 3, 4, 5, 6, 7, and 8, wherein the bond material comprises a ratio ($SiO_2$/($Al_2O_3$ and Al)) of not greater than 9 or not greater than 8.8 or not greater than 8.6 or not greater than 8.4 or not greater than 8.2 or not greater than 8.

Item 61. The abrasive article of any of items 1, 2, 3, 4, 5, 6, 7, and 8, wherein the bond material comprises not greater than 8 wt % calcia (CaO) for a total weight of the bond material or not greater than 6 wt % or not greater than 5 wt % or not greater than 4 wt % or not greater than 3 wt % or not greater than 2 wt %.

Item 62. The abrasive article of any of items 1, 2, 3, 4, 5, 6, 7, and 8, wherein the bond material comprises at least 0.1 wt % calcia (CaO) for a total weight of the bond material or at least 0.5 wt % or at least 0.8 wt % or at least 1 wt %.

Item 63. The abrasive article of any of items 1, 2, 3, 4, 5, 6, 7, and 8, wherein the bond material is essentially free of calcia (CaO).

Item 64. The abrasive article of any of items 1, 2, 3, 4, 5, 6, 7, and 8, wherein the bond material is essentially free of rare earth oxides.

Item 65. The abrasive article of any of items 1, 2, 3, 4, 5, 6, 7, and 8, wherein the bond material is essentially free of alkali earth metal oxides except for CaO.

Item 66. The abrasive article of any of items 1, 2, 3, 4, 5, 6, 7, and 8, wherein the bond material comprises at least 5 wt % boron oxide ($B_2O_3$) for a total weight of the bond material or at least 6 wt % or at least 7 wt % or at least 8 wt % or at least 9 wt % or at least 10 wt % boron oxide ($B_2O_3$).

Item 67. The abrasive article of any of items 1, 2, 3, 4, 5, 6, 7, and 8, wherein the bond material comprises not greater than 24 wt % boron oxide ($B_2O_3$) for a total weight of the bond material or not greater than 22 wt % or not greater than 20 wt % or not greater than 18 wt % or not greater than 17 wt % or not greater than 16 wt %.

Item 68. The abrasive article of any of items 1, 2, 3, 4, 5, 6, 7, and 8, wherein the bond material comprises a ratio ($SiO_2$/$B_2O_3$) of at least 1.5 or at least 1.7 or at least 1.9 or at least 2 or at least 2.1 or at least 2.3.

Item 69. The abrasive article of any of items 1, 2, 3, 4, 5, 6, 7, and 8, wherein the bond material comprises a ratio ($SiO_2$/$B_2O_3$) of not greater than 8 or not greater than 7.8 or not greater than 7.4 or not greater than 7.2 or not greater than 6.9 or not greater than 6.8 or not greater than 6.6 or not greater than 6.4.

Item 70. The abrasive article of any of items 1, 2, 3, 4, 5, 6, 7, and 8, wherein the bond material comprises at least 0.5 wt % sodium oxide ($Na_2O$) for a total weight of the bond material or at least 1 wt % or at least 2 wt % or at least 2.5 wt % or at least 3 wt % or at least 3.5 wt % or at least 4 wt % or at least 4.2 wt % or at least 4.4 wt %.

Item 71. The abrasive article of any of items 1, 2, 3, 4, 5, 6, 7, and 8, wherein the bond material comprises not greater than 15 wt % sodium oxide ($Na_2O$) for a total weight of the bond material or not greater than 12 wt % or not greater than 10 wt % or not greater than 9 wt % or not greater than 8 wt % or not greater than 7 wt % or not greater than 6 wt % or not greater than 5.8 wt %.

Item 72. The abrasive article of any of items 1, 2, 3, 4, 5, 6, 7, and 8, wherein the bond material comprises a ratio ($SiO_2/Na_2O$) of at least 2 or at least 2.5 or at least 3 or at least 3.5 or at least 4 or at least 4.5.

Item 73. The abrasive article of any of items 1, 2, 3, 4, 5, 6, 7, and 8, wherein the bond material comprises a ratio ($SiO_2/Na_2O$) of not greater than 30 or not greater than 28 or not greater than 26 or not greater than 24 or not greater than 22 or not greater than 20 or not greater than 19 or not greater than 18.5.

Item 74. The abrasive article of any of items 1, 2, 3, 4, 5, 6, 7, and 8, wherein the bond material is essentially free of alkali metal oxides except for $Na_2O$.

Item 75. The abrasive article of any of items 1, 2, 3, 4, 5, 6, 7, and 8, wherein the bond material comprises a vitreous phase and a polycrystalline phase.

Item 76. The abrasive article of item 75, wherein the polycrystalline phase comprises zircon ($ZrSiO_4$).

Item 77. The abrasive article of any of items 1, 2, 3, 4, 5, 6, 7, and 8, wherein the bond material comprises at least 15 wt % zircon ($ZrSiO_4$) for a total weight of the bond material or at least 17 wt % or at least 19 wt % or at least 20 wt % or at least 21 wt % or at least 22 wt % or at least 23 wt % or at least 24 wt %.

Item 78. The abrasive article of any of items 1, 2, 3, 4, 5, 6, 7, and 8, wherein the bond material comprises not greater than 44 wt % zircon ($ZrSiO_4$) for a total weight of the bond material or not greater than 42 wt % or not greater than 40 wt % or not greater than 38 wt % or not greater than 36 wt % or not greater than 35 wt % or not greater than 34 wt % or not greater than 33 wt % or not greater than 32 wt %.

Item 79. The abrasive article of any of items 1, 2, 3, 4, 5, 6, 7, and 8, wherein the bond material comprises a ratio ($SiO_2/ZrSiO_4$) of at least 1 or at least 1.05 or at least 1.10.

Item 80. The abrasive article of any of items 1, 2, 3, 4, 5, 6, 7, and 8, wherein the bond material comprises a ratio ($SiO_2/ZrSiO_4$) of not greater than 3 or not greater than 2.8 or not greater than 2.6 or not greater than 2.4 or not greater than 2.2 or not greater than 2 or not greater than 1.9.

Item 81. The abrasive article of any of items 1, 2, 3, 4, 5, 6, 7, and 8, wherein the bond material is essentially free of magnesium (MgO), potassium oxide ($K_2O$), iron oxide ($Fe_2O_3$), and titanium dioxide ($TiO_2$).

Item 82. The abrasive article of any of items 1, 2, 3, 4, 5, 6, 7, and 8, wherein the bond material is essentially free of a metal.

Item 83. The abrasive article of any of items 1, 2, 3, 4, 5, 6, 7, and 8, wherein the bond material contains a mixture of a ceramic material and a metal material, wherein the metal material is present in a minority content, wherein the metal comprises aluminum, wherein the metal consists essentially of aluminum, wherein the metal material is present in an amount of not greater than 5 wt % for the total weight of the bond or not greater than 4.5 wt % or not greater than 4 wt % or not greater than 3.5 wt % or not greater than 3 wt % or not greater than 2.5 wt %.

Item 84. The abrasive article of item 83, wherein the bond material comprises at least 0.3 wt % of a metal material or at least 0.5 wt % or at least 0.8 wt % or at least 1 wt %.

Item 85. The abrasive article of any of items 1, 2, 3, 4, 5, 6, 7, and 8, wherein the bond material is essentially free of a resin material, a thermoset material, and thermoplastic material.

Item 86. The abrasive article of any of items 1, 2, 3, 4, 5, 6, 7, and 8, wherein the bond material is essentially free of aluminum.

Item 87. The abrasive article of any of items 1, 2, 3, 5, and 6, wherein the body comprises an average pore size of at least 70 microns.

Item 88. The abrasive article of any of items 4, 7, 8, and 87, wherein the body comprises an average pore size of at least at least 80 microns or at least 85 microns or at least 90 microns or at least 95 microns or at least 100 microns or at least 110 microns or at least 120 microns or at least 130 microns or at least 140 microns or at least 150 microns or even at least 160 microns.

Item 89. The abrasive article of any of items 4, 7, 8, and 87, wherein the body comprises an average pore size of not greater than 2000 microns or not greater than 1500 microns or not greater than 1000 microns or not greater than 900 microns or not greater than 800 microns or not greater than 700 microns.

Item 90. The abrasive article of any of items 1, 2, 3, 4, 6, 7, and 8, wherein the body comprises a median pore size of at least 45 microns.

Item 91. The abrasive article of any of items 5 and 90, wherein the body comprises median pore size of at least at least 50 microns or at least 55 microns or at least 60 microns or at least 65 microns or at least 70 microns or at least 75 microns or at least 80 microns or at least 85 microns.

Item 92. The abrasive article of any of items 5 and 90, wherein the body comprises a median pore size of not greater than 2000 microns or not greater than 1500 microns or not greater than 1000 microns or not greater than 900 microns or not greater than 800 microns or not greater than 700 microns or not greater than 500 microns or not greater than 200 microns.

Item 93. The abrasive article of any of items 1, 2, 3, 4, 5, 7, and 8, wherein the body comprises an upper quartile pore size limit of at least 85 microns.

Item 94. The abrasive article of any of items 6 and 93, wherein the body comprises an upper quartile pore size limit of at least at least 90 microns or at least 100 microns or at least 110 microns or at least 120 microns or at least 130 microns or at least 140 microns or at least 150 microns or at least 160 microns or at least at least 170 microns or at least 180 microns or at least 190 microns or at least 200 microns.

Item 95. The abrasive article of any of items 6 and 93, wherein the body comprises an upper quartile pore size limit of not greater than 2000 microns or not greater than 1500 microns or not greater than 1000 microns or not greater than 800 microns or not greater than 700 microns or not greater than 500 microns.

Item 96. The abrasive article of any of items 1, 2, 3, 4, 5, 6, and 8, wherein the body comprises an average pore size of at least 70 microns and a pore size standard deviation of at least 77 microns.

Item 97. The abrasive article of any of items 7 and 96, wherein the pore size standard deviation is at least at least 85 microns or at least 90 microns or at least 100 microns or at least 110 microns or at least 120 microns or at least 130 microns or at least 140 microns or at least 150 microns or at least 160 microns or at least at least 170 microns or at least 180 microns or at least 190 microns or at least 200 microns.

Item 98. The abrasive article of any of items 7 and 96, wherein the pore size standard deviation is not greater than 2000 microns or not greater than 1500 microns or not greater than 1000 microns or not greater than 800 microns or not greater than 700 microns or not greater than 500 microns or not greater than 400 microns.

Item 99. The abrasive article of any of items 1, 2, 3, 4, 5, 6, and 7, wherein the body comprises an average pore size of at least 70 microns and a pore size variance of at least 10 microns$^2$.

Item 100. The abrasive article of any of items 8 and 99, wherein the pore size variance is at least at least 15 microns$^2$ or at least 20 microns$^2$ or at least 25 microns$^2$ or at least 30 microns$^2$ or at least 35 microns$^2$ or at least 40 microns$^2$.

Item 101. The abrasive article of any of items 8 and 99, wherein the pore size variance is not greater than 1000 microns$^2$ or not greater than 500 microns$^2$ or not greater than 200 microns$^2$ or not greater than 100 microns$^2$ or not greater than 90 microns$^2$ or not greater than 80 microns$^2$ or not greater than 70 microns$^2$.

Item 102. The abrasive article of any of items 1, 2, 3, 4, 5, 6, 7, and 8, wherein the body comprises a maximum pore size of at least 590 microns or at least 600 microns or at least 700 microns or at least 800 microns or at least 900 microns or at least 1000 microns or at least 1200 microns or at least 1500 microns or at least at least 1700 microns or at least 2000 microns.

Item 103. The abrasive article of any of items 1, 2, 3, 4, 5, 6, 7, and 8, wherein the body comprises a maximum pore size of not greater than 6000 microns or not greater than 5500 microns or not greater than 5000 microns or not greater than 4500 microns or not greater than 4000 microns or not greater than 3500 microns.

Item 104. A method of forming an abrasive article comprising: forming a mixture including abrasive particles comprising silicon carbide and a binder comprising an inorganic material; forming abrasive agglomerates of the abrasive particles and binder by partially curing at least a portion of the binder; mixing the abrasive agglomerates with a bond material; and heat treating the abrasive agglomerates and bond material to form a bonded abrasive comprising abrasive agglomerates contained in a vitreous bond material, wherein the vitreous bond material is formed of a mixture of the binder and bond material.

Item 105. The method of item 104, wherein the binder is essentially free of zircon.

Item 106. The method of item 104, wherein the abrasive particles consist essentially of silicon carbide.

Item 107. The method of item 104, wherein the abrasive particles have an average particle size of at least 0.1 micron and not greater than 5000 microns.

Item 108. The method of item 104, wherein the abrasive agglomerates have an average particle size (D50) of at least 50 microns and not greater than 5000 microns.

Item 109. The method of item 104, wherein forming agglomerates includes heating the mixture to a temperature of at least 100° C. and not greater than 500° C.

Item 110. The method of item 104, wherein forming agglomerates includes heating the mixture in a non-oxidizing atmosphere or in an air atmosphere.

Item 111. The method of item 104, wherein partially curing comprises converting at least a portion of the binder from a solid phase to a liquid phase sufficient to bond a plurality of abrasive particles together to form an abrasive agglomerate.

Item 112. The method of item 104, wherein the binder comprises a material selected from the group consisting of silicon dioxide ($SiO_2$), boron oxide ($B_2O_3$), clay, and a combination thereof.

Item 113. The method of item 104, wherein the bond material has a melting temperature greater than a melting temperature of the binder.

Item 114. The method of item 104, wherein heat treating includes heating the abrasive agglomerates and bond material to a temperature sufficient to cause mixing of the binder and bond material to form the vitreous bond material.

Item 115. The method of item 104, wherein heat treating includes heating the abrasive agglomerates and the bond material to a forming temperature of not greater than about 950° C.

Item 116. The method of item 104, wherein heat treating includes heating the abrasive agglomerates and bond material in air.

Example 1

An exemplary sample of an abrasive article was formed as Sample S1 by obtaining silicon carbide particles having a median particle size of approximately 400 microns from Saint-Gobain Industrial Ceramics, commercially available as 39C Crystolon. The silicon carbide particles, filler material, and binder were mixed together to create the mixture composition as provided in Table 1 below. The filler material included clay, wollastonite, mullite, and alumina. The binder included alkali metal silicate and glass frit. The total content of all the materials in the mixture added up to 100%.

TABLE 1

| | |
|---|---|
| SiC Particles | 86-90 wt % |
| Alkali metal Silicate | 6-9 wt % |
| Filler | 1-5 wt % |
| Glass Frit | 0.5-3 wt % |

The mixture was then partially cured at 150° C. in an air atmosphere for a duration of 3 to 8 minutes.

The abrasive agglomerates were combined with unagglomerated silicon carbide particles from Saint-Gobain Corporation and available as 39C Crystolon and a bond material, which may also be referred to as a precursor bond material. The mixture included 60-65 wt % abrasive agglomerates, 18-22 wt % unagglomerated silicon carbide particles, and 12-16 wt % precursor bond material and 0-3.5 wt % pore formers for the total weight of the mixture. The sum of the components in the mixture is equal to 100%. The composition of the precursor bond material is provided below in Table 2. The precursor bond material had a forming temperature of approximately 900° C.-950° C.

TABLE 2

| | |
|---|---|
| SiO2 | 30-35 |
| Al2O3/Al | 5-8 |
| Fe2O3 | <1 |
| TiO2 | 0.44 |
| CaO | 0-2 |
| MgO | <1 |
| Na2O | 2-4 |
| K2O | 0.07 |
| B2O3 | 14-16 |
| ZrSiO4 | 35-40 |

The mixture of the abrasive agglomerates, unagglomerated silicon carbide particles, and precursor bond material were heat treated at approximately 915° C. for 8 hours in an air atmosphere.

Figure 4:
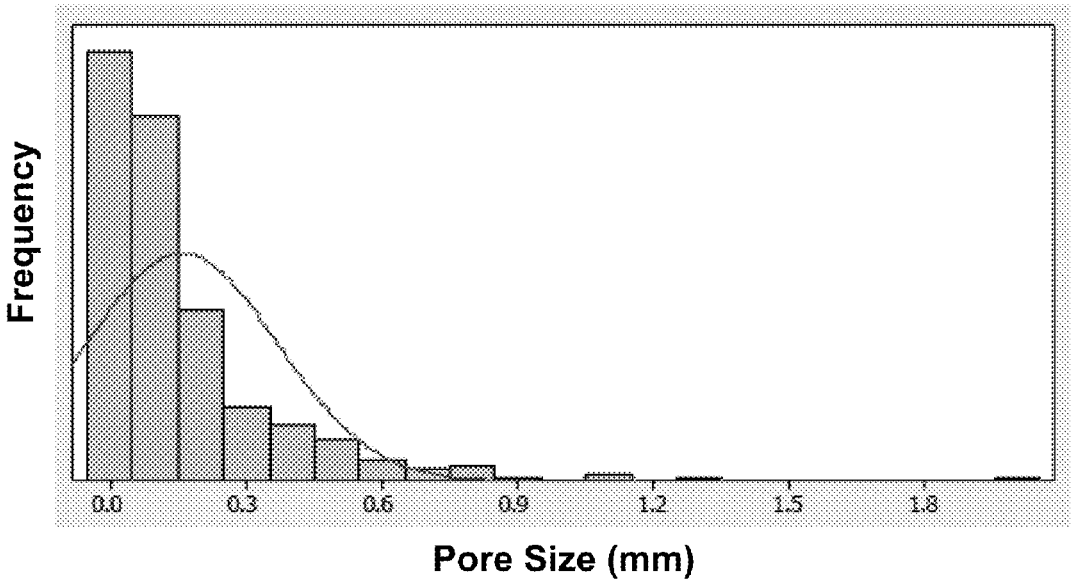
FIG. 4 includes a plot of the pore size distribution for a sample representative of an embodiment.

The heat treating facilitated mixing of the binder from the abrasive agglomerates and the precursor bond material to form a vitreous bond material (i.e., bond material) of the finally-formed bonded abrasive body. The composition of the finally-formed bond material is provided in Table 3. Notably, the body had a permeability of approximately 133, an average pore size of approximately 158 microns, a bond material content of approximately 4-6 vol %, an abrasive agglomerate and unagglomerated abrasive particle content of approximately 36-40 vol % and a porosity content of approximately 54-58 vol %, with the sum of the three components is equal to 100%. The body further had a standard deviation of porosity of approximately 209, a median pore size of approximately 89 microns, an upper quartile pore size limit of approximately 208 microns, and a maximum pore size of approximately 2030 microns. FIG. 2 includes an image of a portion of Sample S1. FIG. 4 includes a plot of the pore size distribution of Sample S1 measured according to the ASTM standard E112 standard.

TABLE 3

| | |
|---|---|
| $SiO_2$ | 37-55 |
| $Al_2O_3$/Al | 7-15 |
| CaO | 0-2 |
| $B_2O_3$ | 9-16 |
| $Na_2O$ | 3-8 |
| ZrSiO4 | 24-32 |

*Less than 1 wt % of MgO, $K_2O$, $Fe_2O_3$, $TiO_2$

Figure 5:
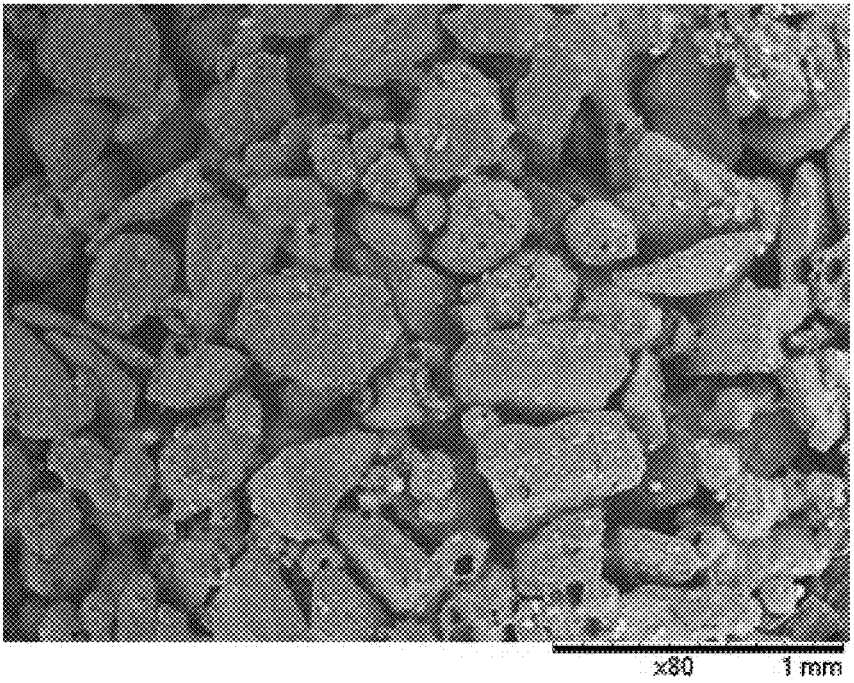
FIG. 5 includes an image of a portion of a conventional abrasive article.
Figure 6:
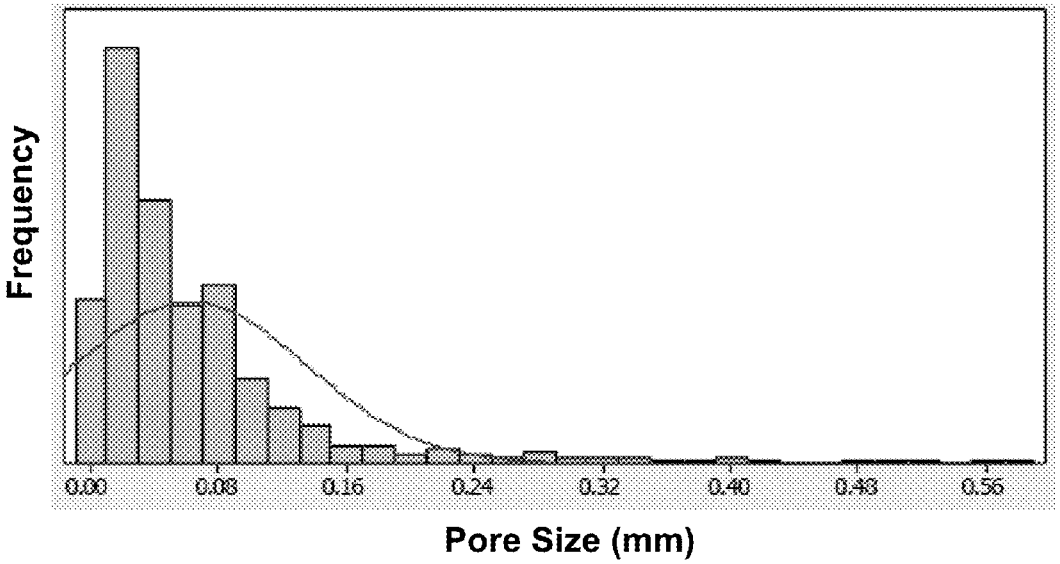
FIG. 6 includes a plot of the pore size distribution for a sample representative of a conventional abrasive article.

A second, conventional sample CS2 was obtained from Saint-Gobain Abrasives, commercially available as 39C60E24VCC for grinding of titanium-based metals. Sample CS2 had 36-38 vol % unagglomerated silicon carbide particles available as 39C Crystolon from Saint-Gobain Abrasives with an average particle size of approximately 75 microns. The abrasive article had a bond material content of approximately 4-6 vol %, a porosity content of approximately 54-56 vol %, and a content of ceramic pore formers (Z-lite sphere) of 5-6 vol %. Sample CS2 had a permeability of approximately 50, an average pore size of 62 microns, and a vitreous bond having a composition provided in Table 4 below. Sample CS2 further had a standard deviation of porosity of approximately 72 microns, a median pore size of approximately 40 microns, an upper quartile pore size limit of approximately 80 microns, and a maximum pore size of approximately 575 microns. FIG. 5 includes an image of a portion of Sample CS2. FIG. 6 includes a plot of the pore size distribution of Sample CS2 measured according to the ASTM standard E112 standard.

TABLE 4

| | |
|---|---|
| SiO2 | 30-35 |
| Al2O3/Al | 4-6 |
| Fe2O3 | <1 |
| TiO2 | <1 |
| CaO | 0-2 |
| MgO | <1 |
| Na2O | 2-4 |
| K2O | <1 |
| B2O3 | 14-16 |
| ZrSiO4 | 35-40 |
| P2O5 | <1 |

Example 2

Another sample, Sample S3 was formed according to the same forming process as provided in Example 1 for Sample S1, except that the abrasive article included 42-46 vol % abrasive, 11-14 vol % bond material, and 44-46 vol % porosity, with the sum of all components equal to 100%. Sample S3 includes no pore formers, and 50 wt % of the total abrasive content is abrasive agglomerates and 50 wt % of the abrasive particle content is unagglomerated abrasive particles, such that the final abrasive article includes approximately 40-44 wt % abrasive agglomerates for the total weight of the body of the abrasive article, 40-44 wt % unagglomerated abrasive particles for the total weight of the body of the abrasive article, and 18-20 wt % bond material for the total weight of the body of the abrasive article, with all components equal to 100%.

A second comparative sample, Sample CS4, was obtained from Saint-Gobain Abrasives, which is commercially available as 39C60L8VK having 48 vol % unagglomerated silicon carbide abrasive particles, 12 vol % bond, and 40 vol % porosity. The permeability of Sample CS4 is lower than that of Sample CS2.

Each of the samples was subject to a grinding test to compare the performance of the abrasive articles. The samples were tested on a workpiece of hot-isostatically pressed TiAl having a duplex microstructure and dimensions of 5 inches×2 inches×0.5 inches. The grinding machine was an Elb Brilliant tool (10 hp maximum spindle power) in a slot grinding orientation with a non-continuous dressing operation and configured to grind slots on the 2 inch dimension of the workpiece. Each of the sample wheels had dimensions of 8 inches (diameter)×0.5 inches (thickness)×1.25 inches (hole diameter).

The wheel speed for all grinds was 30 m/s, grinding was performed at increasing table speeds. At 0.006 inch depth of cut, table speed was increased from 50 inch/min to 200 inch/min, resulting in material removal from 0.3 to 1.2 ($inch^3$/min)/inch. At 0.0012 inch depth of cut, table speed was increased from 25 inch/min to 50 inch/min, resulting in material removal rate of 0.3 and 0.6 ($inch^3$/min)/inch. For each set of conditions, the wheels were tested to 0.108 inches of total downfeed or until material damage (i.e., cracking or burn on the workpiece) was observed.

Figure 7:
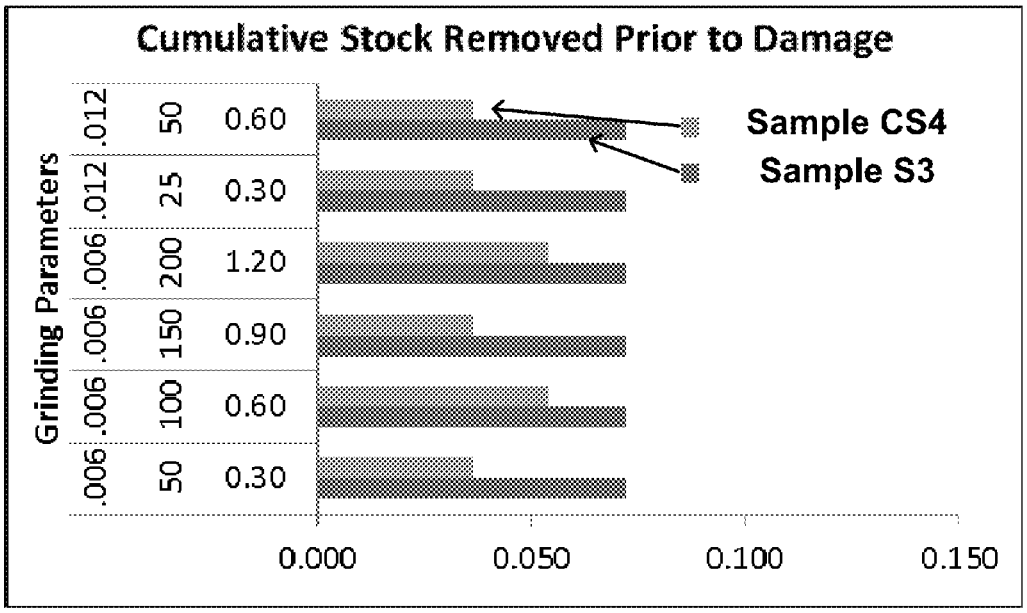
FIG. 7 includes a plot of cumulative stock removed prior to damage for a grinding test for a representative sample and a conventional sample.
Figure 8:
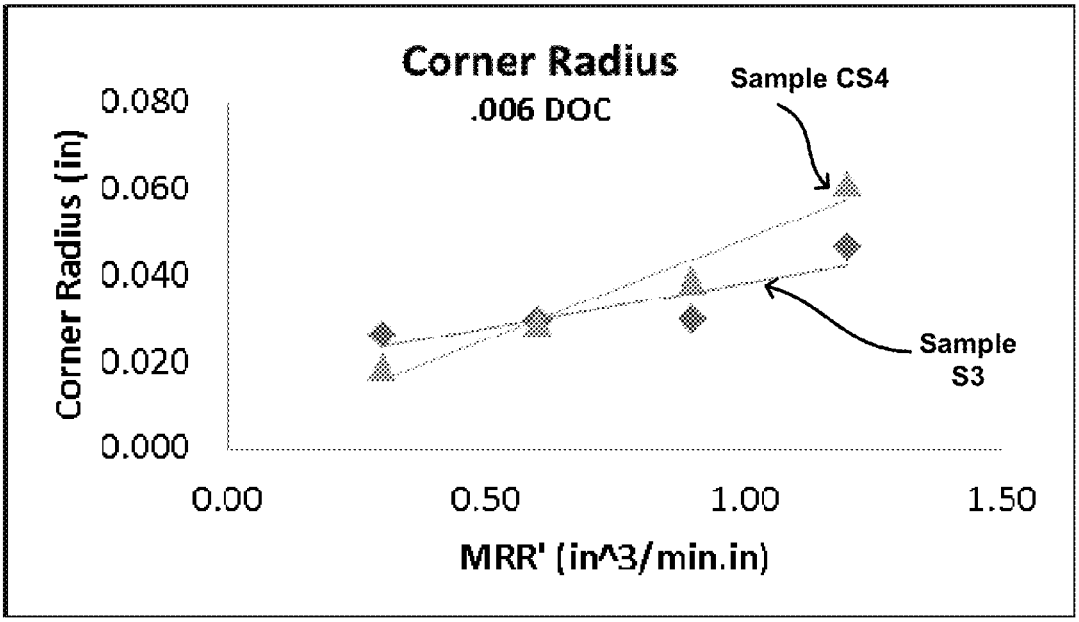
FIG. 8 includes a plot of corner radius for various material removal rates conducting during a grinding test using a representative sample and a conventional sample.

FIG. 7 includes a bar chart of the cumulative stock removed prior to damage to the workpiece for Sample S3 compared to Sample CS4. As illustrated, in all instances, Sample S3 demonstrated remarkably improved stock removal capabilities. In each case, Sample CS4 is the upper bar and Sample S3 is the lower bar, having a greater length and demonstrating more cumulative material removed from the workpiece. FIG. 8 includes a plot of corner radius of the workpiece versus material removal rate for Sample S3 compared to Sample CS4. As illustrated by the data of FIG. 8, Sample S3 demonstrated a capability of lower corner radius and thus improved corner holding abilities, particularly at higher material removal rates, demonstrating improved precision grinding capabilities for high material removal rate grinding operations compared to Sample CS4.

Example 3

Samples according to an embodiment were formed as S4-1 and S4-2 using the same forming process as provided for Sample S1 in Example 1. The compositions of abrasive articles S4-1 and S4-2 are the same as S1, except that the bonded body of articles S4-1 and S4-2 had an abrasive particle content of 44 vol %, a bond material content of 11 vol %, and a porosity of 44-46 vol %. The abrasive particles of Samples S4-1 and S4-2 included 50 wt % of abrasive agglomerates and 50 wt % of unagglomerated abrasive particles for the total weight of the abrasive particles, such that the final abrasive article includes approximately 43.5 wt % abrasive agglomerates for the total weight of the body of the abrasive article, 43.5 wt % unagglomerated abrasive particles for the total weight of the body of the abrasive article, and 13 wt % bond material for the total weight of the body of the abrasive article, with the sum of all components equal to 100 wt %. The compositions of the precursor bond material and the finally-formed bond material of S4-1 and S4-2 were the same as those of S1.

Comparative samples, sample CS5-1 and CS5-2, were obtained from Saint-Gobain Abrasives, which are commercially available as 39C60I8X14 having 48 vol % unagglomerated silicon carbide abrasive particles, 7.20 vol % bond, and 45 vol % porosity.

Each of the samples was subject to a wet surface grinding test on a workpiece of Dura-Bar® cast iron on the Browne and Sharpe surface grinder. All the grinding conditions (e.g., workpiece, coolant conditions, dressing parameters, and testing parameters) are shown in Table 5. The wheel samples were dressed with single point diamond, ground at 3 different infeed rates, and dressed between each infeed rate. Wheel wear and workpiece height was measured before and after grinding to calculate the wheel wear rates and the material removal rates.

embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion.

TABLE 5

| | | | |
|---|---|---|---|
| Coolant: | | | |
| Specification: | | Trim Clear | |
| Concentration: | 1:40 | | |
| Coolant flow conditions: | | Steady stream to cool part | |
| Dressing Conditions: | | | |
| Type: | | Single Point Dresser | |
| Dress Comp (in): | 0.001 | | |
| Dresser cross speed (in/min) | 10 | | |
| Grinding Data: | | | |
| Cutting speed, Vs (sfpm) | 5000 | | |
| Table Traverse (ipm): | 600 | | |
| Infeed Rates (in/min) | 0.0005 | 0.0010 | 0.0015 |
| Target Q' ($inch^3$/min inch) | 0.5 | 1.0 | 1.4 |
| Total Downfeed (in) | 0.020 | 0.020 | 0.021 |
| Instructions: | Dress and true wheel between infeed rates, begin testing at lowest infeed and increase rates to most aggressive condition. | | |

Figure 9:
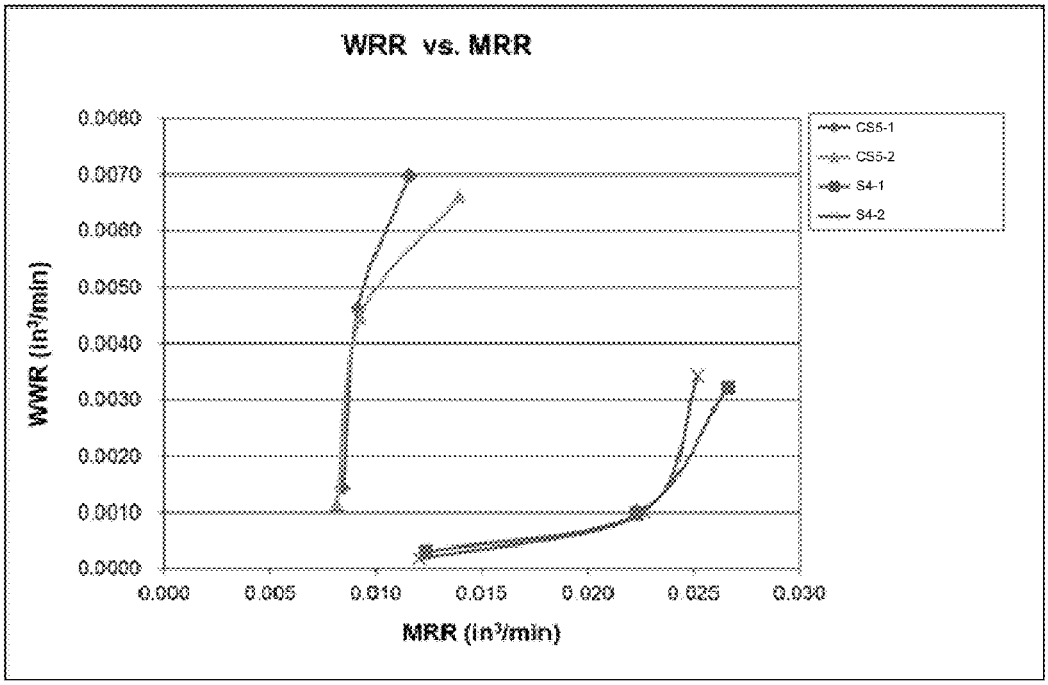
FIG. 9 includes a plot of wheel wear rate versus material removal rate during a grinding test using representative samples and conventional samples.
Figure 10:
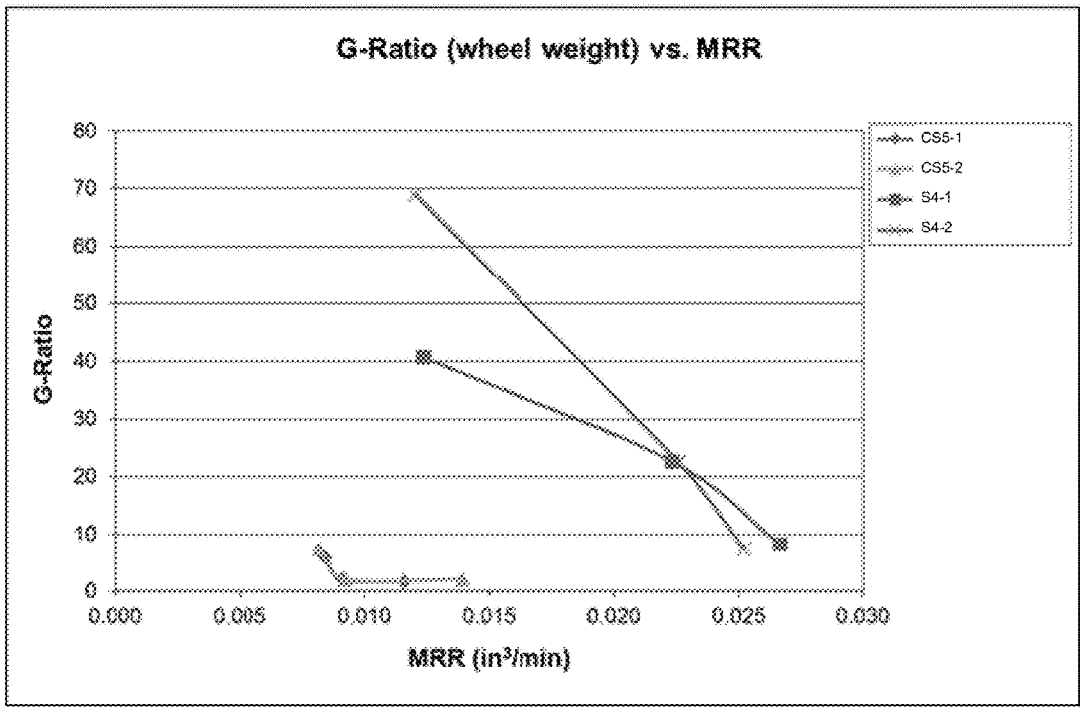
FIG. 10 includes a plot of G-ratio versus material removal rate during a grinding test using representative samples and conventional samples.

FIG. 9 includes a plot of wheel wear rate versus material removal rate for Samples S4-1 and S4-2 compared to Samples CS5-1 and CS5-2. As illustrated, Samples S4-1 and S4-2 demonstrated significantly higher cast iron removal rate but lower wheel wear rate. FIG. 10 includes a plot of G-ratio versus material removal rate for Samples S4-1 and S4-2 compared to Samples CS5-1 and CS5-2. As illustrated, Samples S4-1 and S4-2 demonstrated remarkably improved cast iron removal capabilities and significantly higher G-ratio.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive article comprising:
a body including:
a bond material comprising an inorganic material comprising a ceramic, wherein the bond material comprises at least 15 wt % and not greater than 44 wt % zircon ($ZrSiO_4$) for a total weight of the bond material;
abrasive agglomerates comprising silicon carbide contained within the bond material; and
a permeability of at least 60.

2. The abrasive article of claim 1, wherein the body comprises a permeability of at least 65 to not greater than 300.

3. The abrasive article of claim 1, wherein the body comprises at least 25 vol % to not greater than 55 vol % abrasive agglomerates for a total volume of the body.

4. The abrasive article of claim 1, wherein the abrasive agglomerates comprise abrasive particles and wherein the abrasive particles comprise carbide-based materials.

5. The abrasive article of claim 1, wherein the abrasive agglomerates comprises at least 91% silicon carbide for a total content of abrasive particles in the agglomerates.

6. The abrasive article of claim 1, wherein the abrasive agglomerates comprise abrasive particles and essentially all of the abrasive particles are silicon carbide.

7. The abrasive article of claim 1, wherein the abrasive agglomerates comprise abrasive particles and the abrasive particles comprise not greater than 9% alumina for a total percentage of abrasive particles.

8. The abrasive article of claim 1,
wherein the body includes:
the bond material of at least 3 vol % and not greater than 20 vol % for a total volume of the body;
the abrasive agglomerates of at least 25 vol % and not greater than 55 vol % for the total volume of the body;
unagglomerated abrasive particles of at least 1 vol % and not greater than 30 vol % for the total volume of the body; and
a porosity of at least 40 vol % and not greater than 64 vol % for the total volume of the body; and
wherein the bond material further comprises:
$SiO_2$ of at least 30 wt % and not greater than 60 wt % for the total weight of the bond material;
$B_2O$ of at least 5 wt % and not greater than 54 wt % for the total weight of the bond material; and
$Al_2O_3$ of at least 4 wt % and not greater than 18 wt % for the total weight of the bond material.

9. The abrasive article of claim 1, wherein the body includes an average pore size of at least 70 microns and a pore size standard deviation of at least 77 microns.

10. An abrasive article comprising:
a body including:
a bond material comprising an inorganic material comprising a ceramic, wherein the bond material comprises zircon ($ZrSiO_4$); of at least 15 wt % and not greater than 44 wt % for a total weight of the bond material;
abrasive agglomerates comprising silicon carbide contained within the bond material;
a ceramic pore former contained within the bond material, the ceramic pore former present in an amount of not greater than 5 vol % for a total volume of the body; and
a porosity of at least 40 vol % for the total volume of the body.

11. The abrasive article of claim 10, wherein the bond material comprises:
zircon ($ZrSiO_4$) of at least 24 wt % and not greater than 32 wt % for the total weight of the bond material;
$SiO_2$ of at least 30 wt % and not greater than 60 wt % for a total weight of the bond material;
$B_2O$ of at least 5 wt % and not greater than 54 wt % for the total weight of the bond material; and
$Al_2O_3$ of at least 4 wt % and not greater than 18 wt % for the total weight of the bond material.

12. The abrasive article of claim 10, wherein the body comprises a median pore size of at least 45 microns.

13. The abrasive article of claim 10, wherein the abrasive agglomerates comprises at least 91% silicon carbide for the total content of abrasive particles in the agglomerates.

14. The abrasive article of claim 10, wherein the body comprises a permeability of at least 60.

15. The abrasive article of claim 10, wherein the body comprises an abrasive agglomerates content (Caa) and a bond material content (Cbm) as measured in vol % for a total volume of the body, and wherein the body comprises an agglomerates/bond ratio (Caa/Cbm) of at least 2.

16. An abrasive article comprising:
a body including:
a bond material of at least 4 vol % and not greater than 15 vol % for a total volume of the body, wherein the bond material comprises inorganic material comprising a ceramic;
abrasive agglomerates contained within the bond material comprising silicon carbide particles, wherein the body comprises the abrasive agglomerates of at least 25 vol % and not greater than 55 vol % for the total volume of the body;

a porosity of at least 40 vol % and not greater than 58 vol % for a total volume of the body; and a permeability of at least 60, wherein the bond material comprises:

zircon ($ZrSiO_4$) of at least 24 wt % and not greater than 32 wt % for a total weight of the bond material;

$SiO_2$ of at least 37 wt % and not greater than 55 wt % for a total weight of the bond material; and $B_2O$ of at least 9 wt % and not greater than 16 wt % for the total weight of the bond material; and $Al_2O_3$ of at least 6 wt % and not greater than 18 wt % for the total weight of the bond material.

17. The abrasive article of claim 16, wherein the abrasive agglomerates comprise abrasive particles and the abrasive particles consist essentially of silicon carbide.

18. The abrasive article of claim 16, wherein the body further comprises unagglomerated abrasive particles and a total content of the abrasive agglomerates and the unagglomerated abrasive particles is at least 36 vol % and not greater than 46 vol % for the total volume of the body.

19. The abrasive article of claim 18, wherein the unagglomerated abrasive particles consist essentially of silicon carbide.

20. The abrasive article of claim 16, wherein the bond material comprises a forming temperature of not greater than about 950° C.

* * * * *